US011192020B1

(12) United States Patent
Knybel

(10) Patent No.: US 11,192,020 B1
(45) Date of Patent: Dec. 7, 2021

(54) DUAL-SIDED PLAYING PIECE GAME APPARATUS AND METHOD OF PLAY

(71) Applicant: Matthew Knybel, Chesterfield, MI (US)

(72) Inventor: Matthew Knybel, Chesterfield, MI (US)

( * ) Notice: Subject to any disclaimer, the term of this patent is extended or adjusted under 35 U.S.C. 154(b) by 0 days.

(21) Appl. No.: 17/097,567

(22) Filed: Nov. 13, 2020

Related U.S. Application Data

(60) Provisional application No. 62/935,191, filed on Nov. 14, 2019.

(51) Int. Cl.

| | |
|---|---|
| ***A63F 1/10*** | (2006.01) |
| ***A63F 3/00*** | (2006.01) |
| ***A63F 9/04*** | (2006.01) |
| *A63F 1/04* | (2006.01) |
| *A63F 1/06* | (2006.01) |
| *A63F 3/04* | (2006.01) |

(52) U.S. Cl.
CPC ..... *A63F 3/00697* (2013.01); *A63F 3/00214* (2013.01); *A63F 3/00574* (2013.01); *A63F 9/04* (2013.01); *A63F 1/062* (2013.01); *A63F 1/10* (2013.01); *A63F 3/00094* (2013.01); *A63F 3/0415* (2013.01); *A63F 3/0423* (2013.01); *A63F 2001/0408* (2013.01); *A63F 2001/0416* (2013.01); *A63F 2003/0081* (2013.01); *A63F 2003/0087* (2013.01); *A63F 2003/00223* (2013.01); *A63F 2003/00457* (2013.01); *A63F 2003/00599* (2013.01); *A63F 2003/00772* (2013.01); *A63F 2003/00813* (2013.01)

(58) Field of Classification Search
CPC .... A63F 2003/0087; A63F 1/10; A63F 1/062; A63F 3/00094; A63F 3/0415; A63F 3/0423; A63F 2003/00779; A63F 2003/0081; A63F 2003/00813
USPC ..... 273/296, 293, 271
See application file for complete search history.

(56) References Cited

U.S. PATENT DOCUMENTS

| | | | | |
|---|---|---|---|---|
| 3,165,318 | A * | 1/1965 | Lissandrello | A63F 3/0423 273/272 |
| 3,215,435 | A * | 11/1965 | Rheingruber | A63F 3/00006 273/249 |
| 3,654,712 | A * | 4/1972 | Bagdasar | G09B 17/00 434/170 |
| 3,876,206 | A | 4/1975 | Moura | |
| 4,998,737 | A | 3/1991 | Lamle | |
| 6,578,848 | B1 | 6/2003 | Champion et al. | |
| 7,597,326 | B2 | 10/2009 | D'Antonio | |

(Continued)

*Primary Examiner* — Benjamin Layno
(74) *Attorney, Agent, or Firm* — Christopher P. Maiorana, P.C.

(57) ABSTRACT

A game apparatus comprises a set of fifteen dual-sided playing pieces, a pair of dice, a stock tray, and at least two collector trays. Each of the dual-sided playing pieces has a first face comprising an indicia selected from a plurality of indicia and a second face, opposite the first face, comprising another indicia selected from the plurality of indicia. Each die comprises a number of facets corresponding to the number of indicia in the plurality of indicia. The stock tray is configured to hold a predetermined number of the dual-sided playing pieces that are available for play. Each of the at least two collector trays are configured to hold a predetermined number of the dual-sided playing pieces that are no longer available for play.

20 Claims, 21 Drawing Sheets

(56) References Cited

U.S. PATENT DOCUMENTS

| | | | | |
|---|---|---|---|---|
| 8,454,021 | B2 | 6/2013 | Yu | |
| 9,931,564 | B2 | 4/2018 | Murthy | |
| 2006/0217168 | A1 | 9/2006 | Polgar | |
| 2012/0313321 | A1* | 12/2012 | Yu | A63F 3/0423 273/146 |
| 2016/0263471 | A1 | 9/2016 | O'Connor | |
| 2018/0229106 | A1* | 8/2018 | Mathews | A63F 3/0415 |

* cited by examiner

DUAL-SIDED PLAYING PIECE GAME APPARATUS AND METHOD OF PLAY

This application relates to U.S. Provisional Application No. 62/935,191, filed Nov. 14, 2019, which is hereby incorporated by reference in its entirety.

FIELD OF THE INVENTION

The invention relates to multiple player games generally and, more particularly, to a method and/or apparatus for implementing a dual-sided playing piece game apparatus and method of play.

BACKGROUND

Classic abstract strategy games (e.g., chess, checkers, Risk®, Stratego®, etc.) involve two players or teams and use a board that defines the playing area. Board games of various types and configurations have generally been popular. Games involving mental agility and skills (e.g., concentration, memory retention, problem solving, strategy, etc.) also serve to enhance and increase player's mental development. Many existing games are too complex, take too much time and effort to learn, need a large number of playing pieces, and take too long a period to play a single game, which can result in loss of interest for many players.

It would be desirable to implement a dual-sided playing piece game apparatus and method of play that is easy to learn, portable and played without a board.

SUMMARY

The invention encompasses an aspect concerning a game apparatus comprising a set of fifteen dual-sided playing pieces, a pair of dice, a stock tray, and at least two collector trays. Each of the dual-sided playing pieces has a first face comprising an indicia selected from a plurality of indicia and a second face, opposite the first face, comprising another indicia selected from the plurality of indicia. Each die comprises a number of facets corresponding to the number of indicia in the plurality of indicia. The stock tray is configured to hold a predetermined number of the dual-sided playing pieces that are available for play. Each of the at least two collector trays are configured to hold a predetermined number of the dual-sided playing pieces that are no longer available for play.

The invention also encompasses an aspect concerning a method of playing a game comprising the steps of (a) placing eight out of a set of fifteen dual-sided playing pieces on a surface, arranged in a square having three dual-sided playing pieces on a side, where each dual-sided playing piece has a first face comprising an indicia selected from a plurality of indicia and a second face, opposite the first face, comprising another indicia selected from the plurality of indicia, (b) placing a stock tray within an area defined by the eight dual-sided playing pieces on the surface, (c) placing a remaining number of the set of fifteen dual-sided playing pieces in slots of the stock tray according to set-up instructions of the game, and (d) taking turns until a player has arranged three dual-sided playing pieces having a similar indicia, oriented in a predetermined direction and in a line parallel to a side of the square, where each of the turns involves rolling die and at least one of flipping one of the dual-sided playing pieces, rotating one of the dual-sided playing pieces, or shifting one of the dual-sided playing pieces.

BRIEF DESCRIPTION OF THE FIGURES

Embodiments of the invention will be apparent from the following detailed description and the appended claims and drawings in which:

DETAILED DESCRIPTION OF THE EMBODIMENTS

Embodiments of the present invention include providing a dual-sided playing piece game apparatus and method of play that may (i) be played by two or four players, (ii) develop memory skills, (iii) develop strategy skills, (iv) be simple to learn, (v) be played on any relatively flat and/or level surface, (vi) be portable, and/or (vii) be easily implemented.

Figure 1:
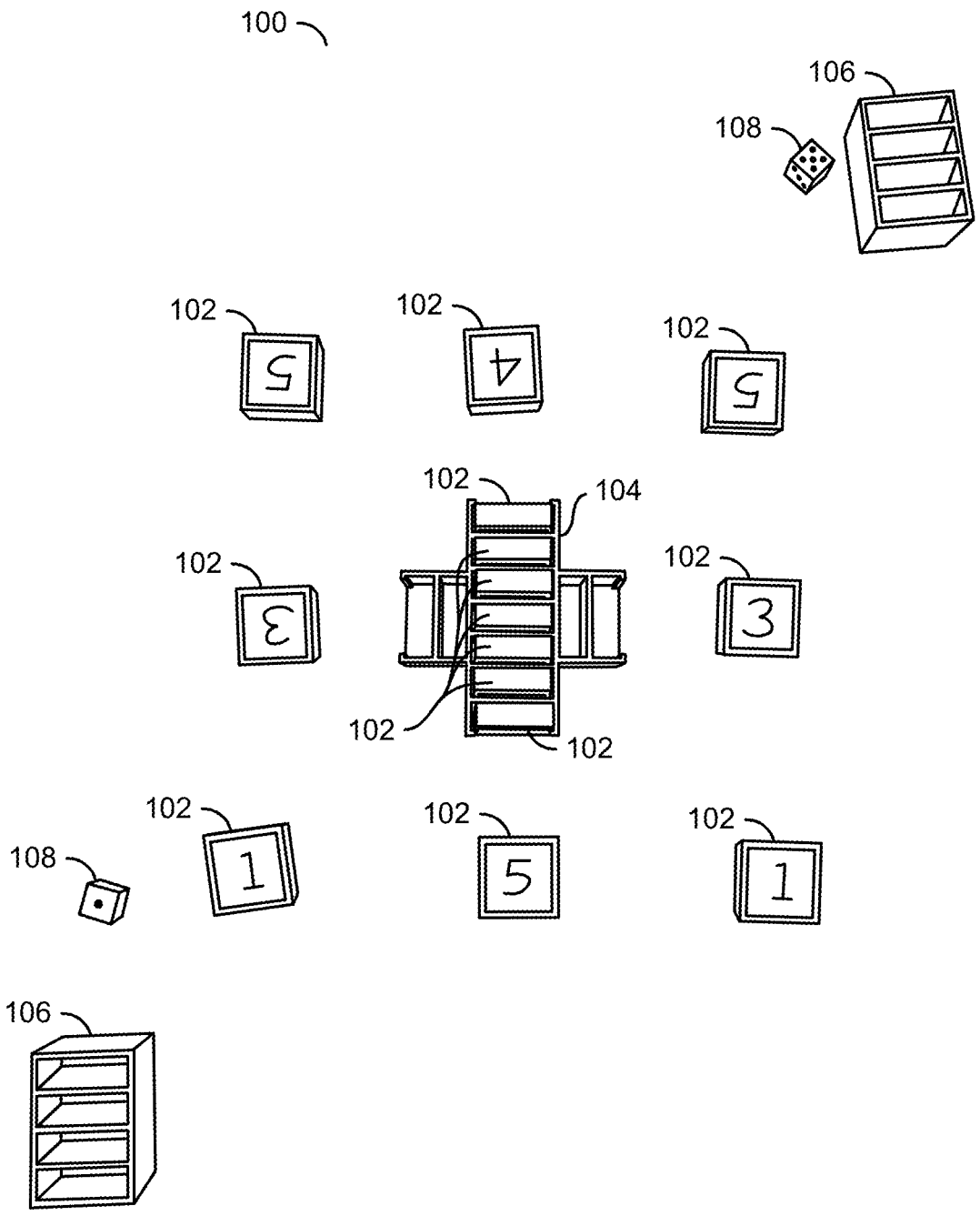
FIG. 1 is a diagram illustrating an initial 2-player set up of a game apparatus in accordance with an example embodiment of the invention.

Referring to FIG. 1, a diagram is shown illustrating an initial 2-player set up of a game apparatus 100 in accordance with an embodiment of the invention. In various embodiments, the apparatus 100 comprises a set of fifteen dual-sided playing pieces 102, a stock tray 104, at least two collector trays 106, and a pair of dice 108. A set of rules for playing the game is generally included with the apparatus 100. The set of rules generally includes two-player and four-player (or team) variations of playing the game.

In an example, the dual-sided playing pieces 102 may be implemented as tiles (or blocks). In another example, the dual-sided playing pieces 102 may be implemented as cards. Each of the dual-sided playing pieces 102 generally has a first face comprising an indicia selected from a plurality of indicia and a second face, opposite the first face, comprising another indicia selected from the plurality of indicia. In various embodiments, the plurality of indicia comprises six unique indicia. In the various embodiments implementing six unique indicia, each indicia occurs in the set of dual-sided playing pieces 102 five times. In general, the same indicia does not occur on both faces of a dual-sided playing piece 102.

In embodiments where the dual-sided playing pieces 102 are implemented as tiles, each dual-sided playing piece may have four rectangular sides (or faces) that are perpendicular to the first and the second faces to provide the dual-sided playing pieces with a predetermined thickness. Each die 108 generally comprises a number of facets corresponding to the number of indicia in the plurality of indicia. In an example where the game is implemented with a set of six indicia, each of the dice 108 may be implemented as a standard six sided die.

The stock tray 104 is generally implemented having a cross (or plus) shape. The stock tray 104 is generally configured to hold a predetermined number of the dual-sided playing pieces 102 that are available for play. In various embodiments, the stock tray 104 comprises eleven slots, seven slots coaxially aligned along a first axis and four slots coaxially aligned along a second axis perpendicular to the first axis. The four slots along the second axis are divided into two groups of two slots with each group on an opposite side of the seven slots along the first axis. Each of the eleven slots is generally configured to hold one of the dual-sided playing pieces 102. The seven internal slots of the stock tray 104 are generally configured to hide the indicia on the two sides of the dual-sided playing pieces 102. The four slots on the outside of the stock tray 104 are generally configured to expose the indicia on one side of the dual-sided playing piece 102 within each slot (e.g., illustrated in FIG. 2).

Each of the at least two collector trays 106 may be configured to hold a predetermined number of the dual-sided playing pieces 102 that are no longer available for play. In various embodiments, the collector trays 106 may be configured to hold up to four dual-sided playing pieces 102. The collector trays 106 generally hold the dual-sided playing pieces 102 that are no longer in play as well as provide a simple method of keeping score.

Figure 6:
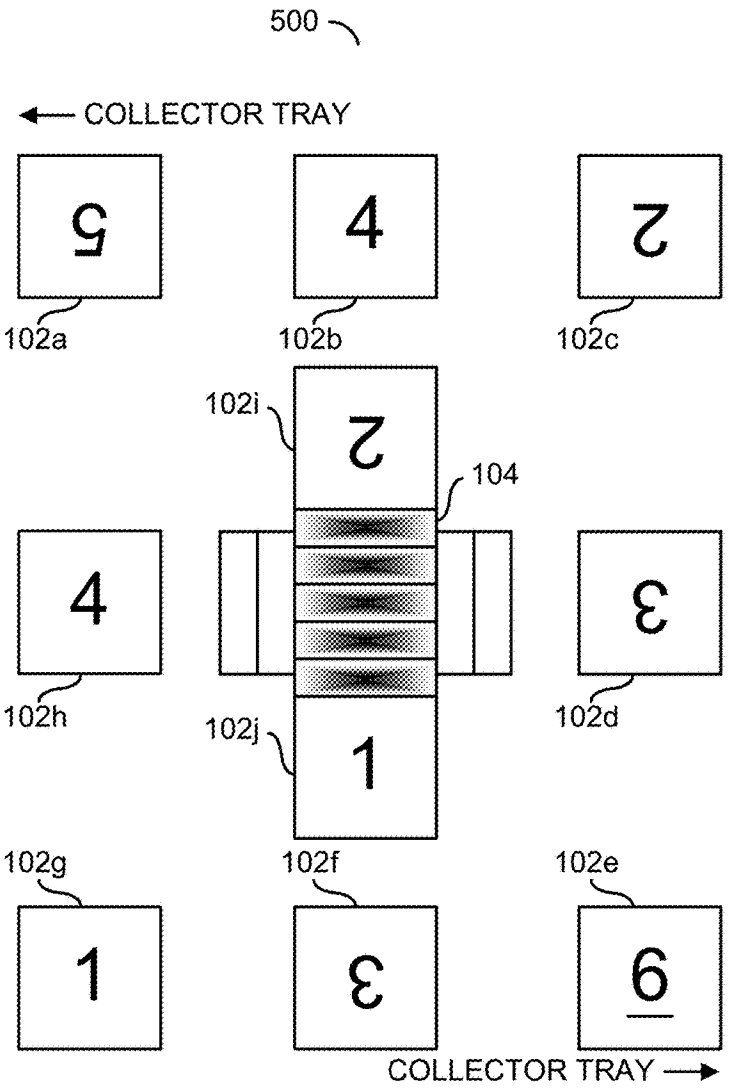

When the apparatus 100 is set up for two players, the first axis of the stock tray 104 with the seven slots is lined up between the two players. Eight of the fifteen dual-sided playing pieces 102 are laid out around the stock tray 104 in a 3×3 grid pattern with the stock tray 104 sitting in the center. Each of the eight dual-sided playing pieces 102 around the stock tray 104 has one of the sides containing an indicia facing up. In an example, the eight dual-sided playing pieces 102 may be laid out with the indicia oriented as illustrated in FIG. 6. The remaining seven dual-sided playing pieces 102 are placed in the seven slots of the stock tray 104 along the first axis. The four slots along the second axis are left empty. Each player gets a collector tray 106 and one of the dice 108. In various embodiments, the dual-sided playing pieces 102, the stock tray 104, and the collector trays 106 may be constructed from at least one of wood, a metallic material, a ceramic material, a resin material, a polymer material, or a plastic material.

Figure 2:
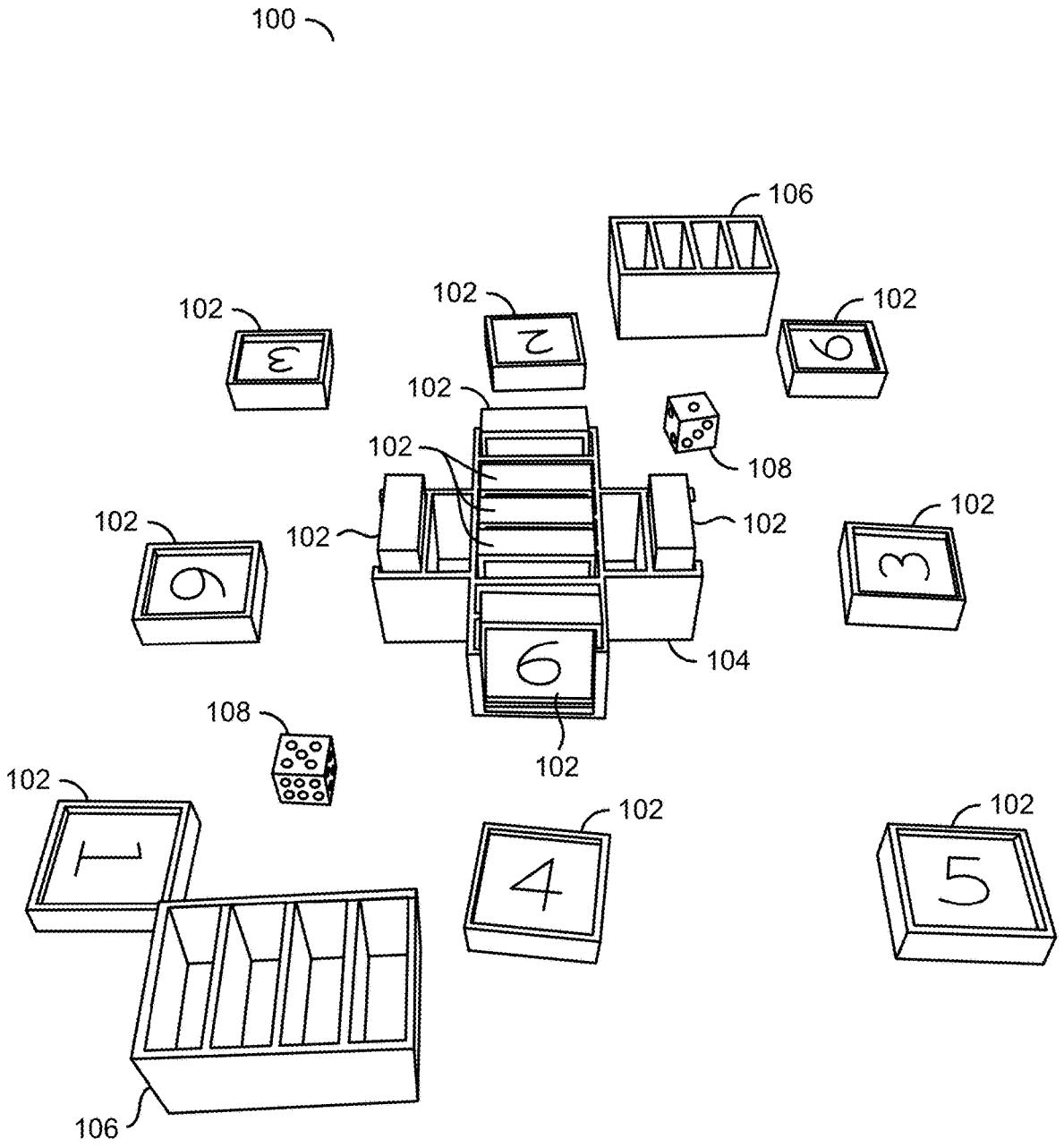
FIG. 2 is a diagram illustrating an initial 4-player set up of the game apparatus in accordance with an example embodiment of the invention.
Figure 16:
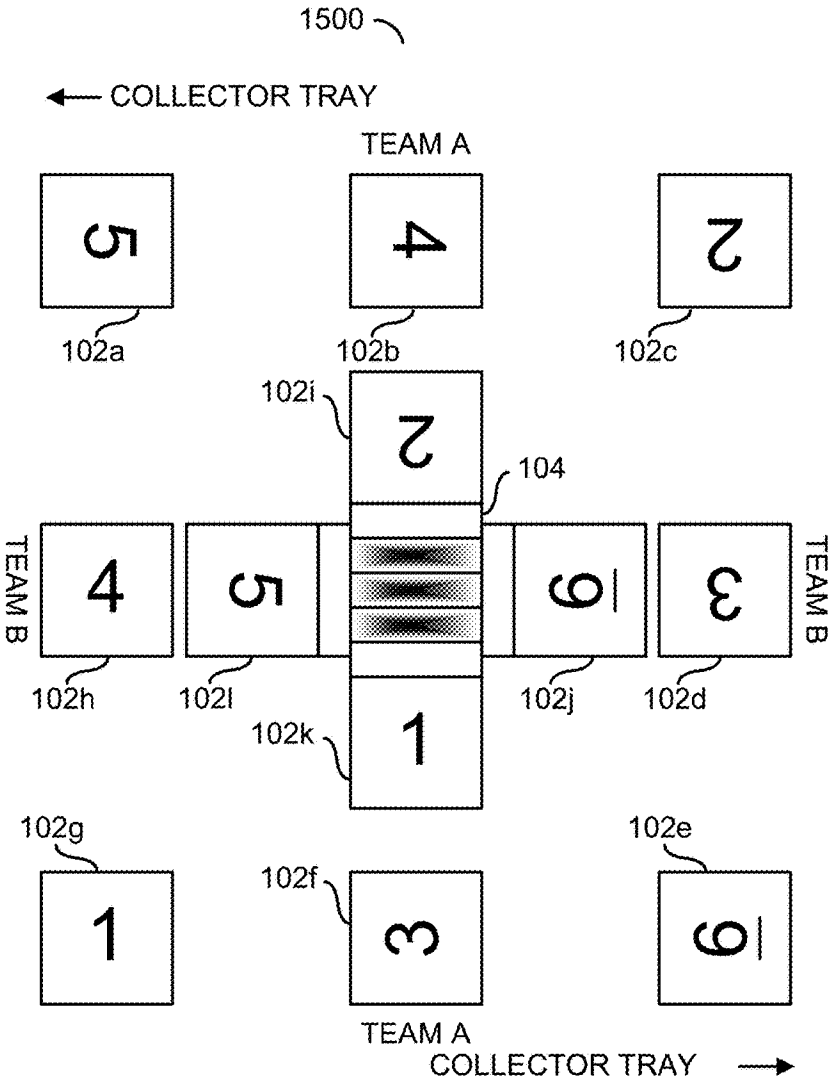

Referring to FIG. 2, a diagram is shown illustrating an initial 4-player set up of the apparatus 100 from a perspective of a player. When the apparatus 100 is set up for four players (or two teams), the first axis of the stock tray 104 with the seven slots is line up between the two players of a first team (e.g., TEAM A) and the second axis of the stock tray 104 with the four slots is line up between the two players of a second team (e.g., TEAM B). Eight of the fifteen dual-sided playing pieces 102 are laid out around the stock tray 104 in the 3×3 grid pattern with the stock tray 104 sitting in the center. Each of the eight dual-sided playing pieces 102 around the stock tray has one of the sides containing an indicia facing up. In an example, the eight dual-sided playing pieces 102 may be laid out with the indicia oriented as illustrated in FIG. 16. Four of the dual-sided playing pieces 102 are placed in the outside slots of the stock tray 104 so each player can see an indicia on a side of the dual-sided playing piece 102 facing them. The remaining three dual-sided playing pieces 102 are placed in the middle three slots along the first axis of the stock tray 104. Each team gets a collector tray 106 and one of the dice 108.

Figure 3B:
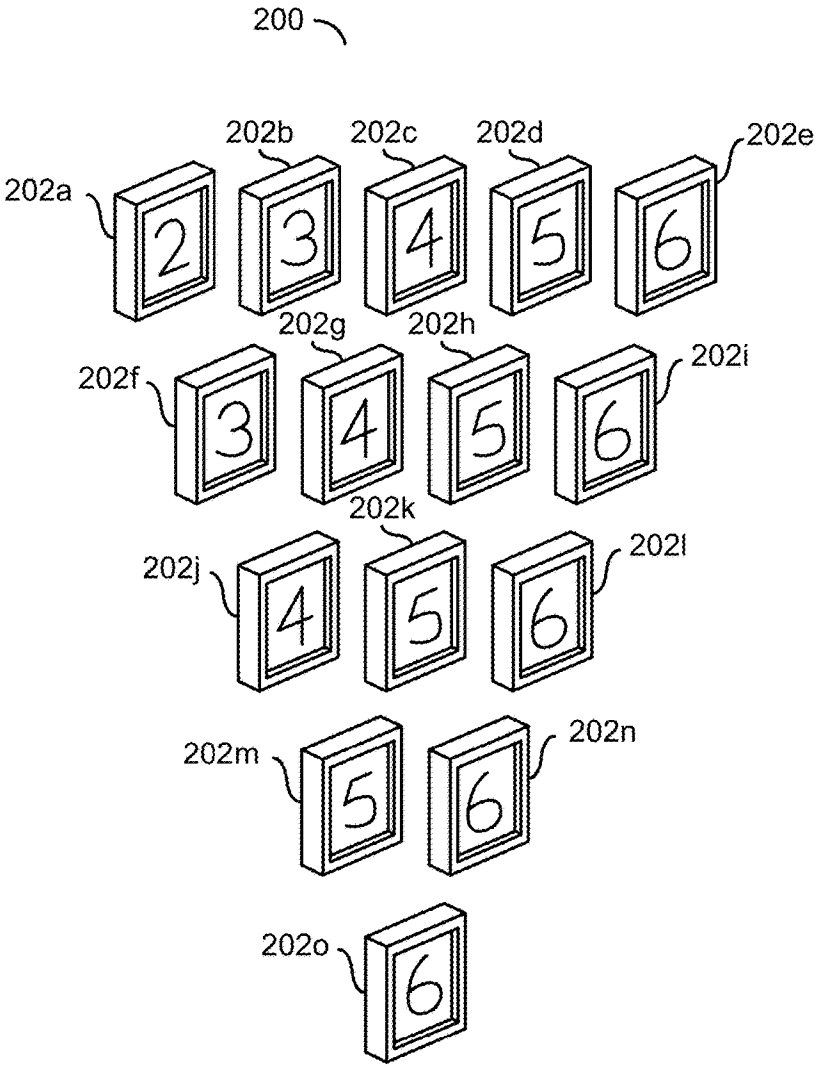
FIGS. 3A and 3B are diagrams illustrating an example set of dual-sided playing pieces (or tiles) of a game apparatus in accordance with an example embodiment of the invention.
Figure 3A:
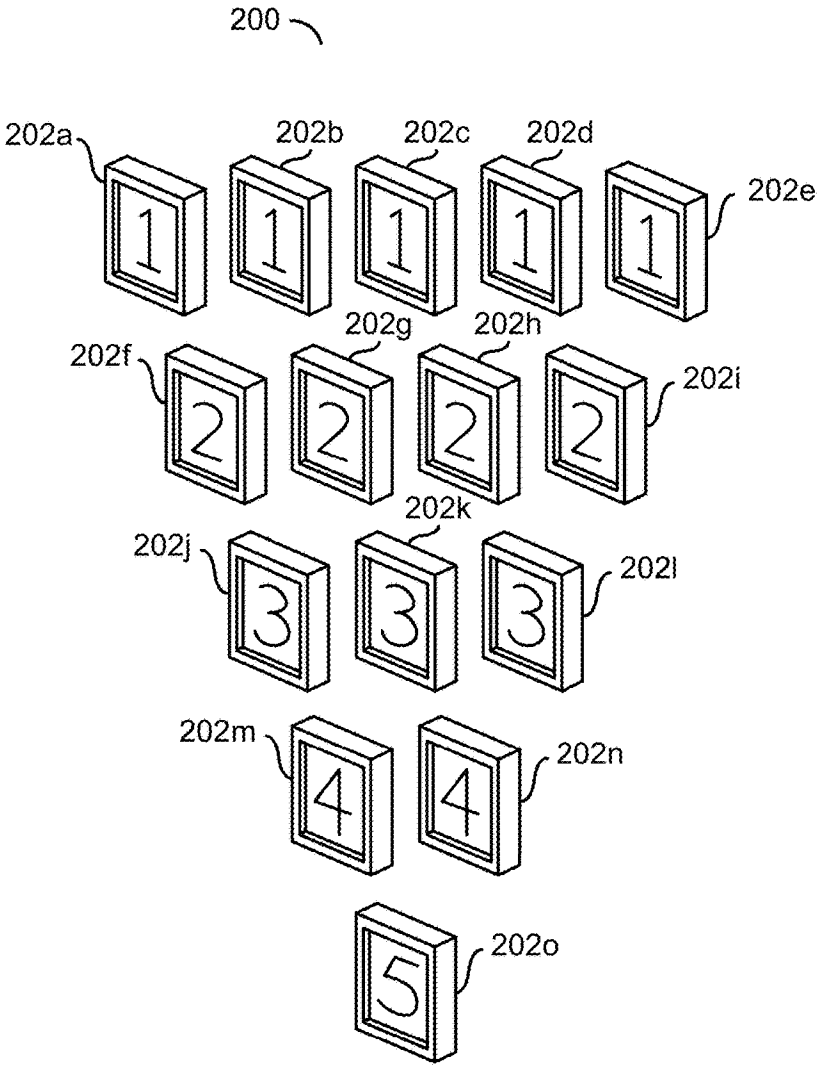

Referring to FIGS. 3A and 3B, diagrams are shown illustrating first (front) faces (FIG. 3A) and second (back) faces (FIG. 3B) of an example set of dual-sided playing pieces 200 in accordance with an example embodiment of the invention. The dual-sided playing pieces 200 may be used in place of the dual-sided playing pieces 102 shown in FIGS. 1 and 2. In an example, the set of dual-sided playing pieces 200 comprises fifteen dual-sided playing pieces 202*a*-202*o* and six indicia (e.g., numerals 1, 2, 3, 4, 5, and 6). Each of the front faces of the dual-sided playing pieces 202*a*-202*o* generally has a first indicia (e.g., the numerals 1, 2, 3, 4, or 5) and each of the back faces of the dual-sided playing pieces 202*a*-202*o* generally has a second indicia (e.g., the numerals 2, 3, 4, 5, or 6) that is different from the first indicia on the respective front faces of the dual-sided playing pieces 202*a*-202*o*.

In an example embodiment, the front face of the dual-sided playing pieces 202*a*-202*e* may have a first of the six indicia (e.g., the numeral 1), the front face of the dual-sided playing pieces 202*f*-202*i* may have a second of the six indicia (e.g., the numeral 2), the front face of the dual-sided playing pieces 202*j*-2021 may have a third of the six indicia (e.g., the numeral 3), the front face of the dual-sided playing pieces 202*m* and 202*n* may have a fourth of the six indicia (e.g., the numeral 4), and the front face of the dual-sided playing piece 202*o* may have a fifth of the six indicia (e.g., the numeral 5). In an example, the back face of the dual-sided playing pieces 202*a*-202*e* may have an indicia different from the front face and each other (e.g., the numerals 2, 3, 4, 5, and 6), the back faces of the dual-sided playing pieces 202*f*-202*i* may have an indicia different from the front faces of the dual-sided playing pieces 202*a*-202*i* and each other (e.g., the numerals 3, 4, 5, and 6), the back faces of the dual-sided playing pieces 202*j*-2021 may have an indicia different from the front faces of the dual-sided playing pieces 202*a*-2021 and each other (e.g., the numerals 4, 5, and 6), the front faces of the dual-sided playing pieces 202*m* and 202*n* may have an indicia different from the front faces of the dual-sided playing pieces 202*a*-202*n* and each other (e.g., the numerals 5 and 6), and the front face of the dual-sided playing piece 202*o* may have the sixth of the six indicia (e.g., the numeral 6). The distribution of the six indicia among the faces of the fifteen dual-sided playing pieces 202*a*-202*o* is generally configured to ensure that players may form sets during game play.

Figure 4B:
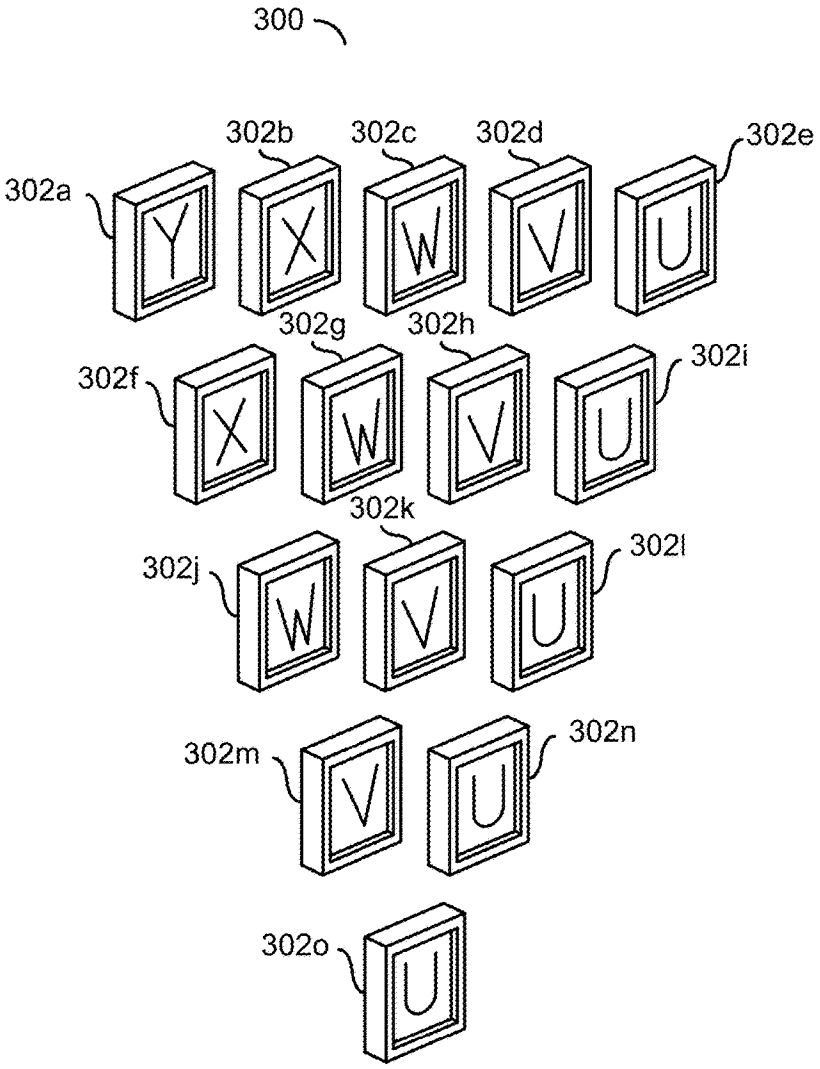
FIGS. 4A and 4B are diagrams illustrating another example set of dual-sided playing pieces (or tiles) of a game apparatus in accordance with an example embodiment of the invention.
Figure 4A:
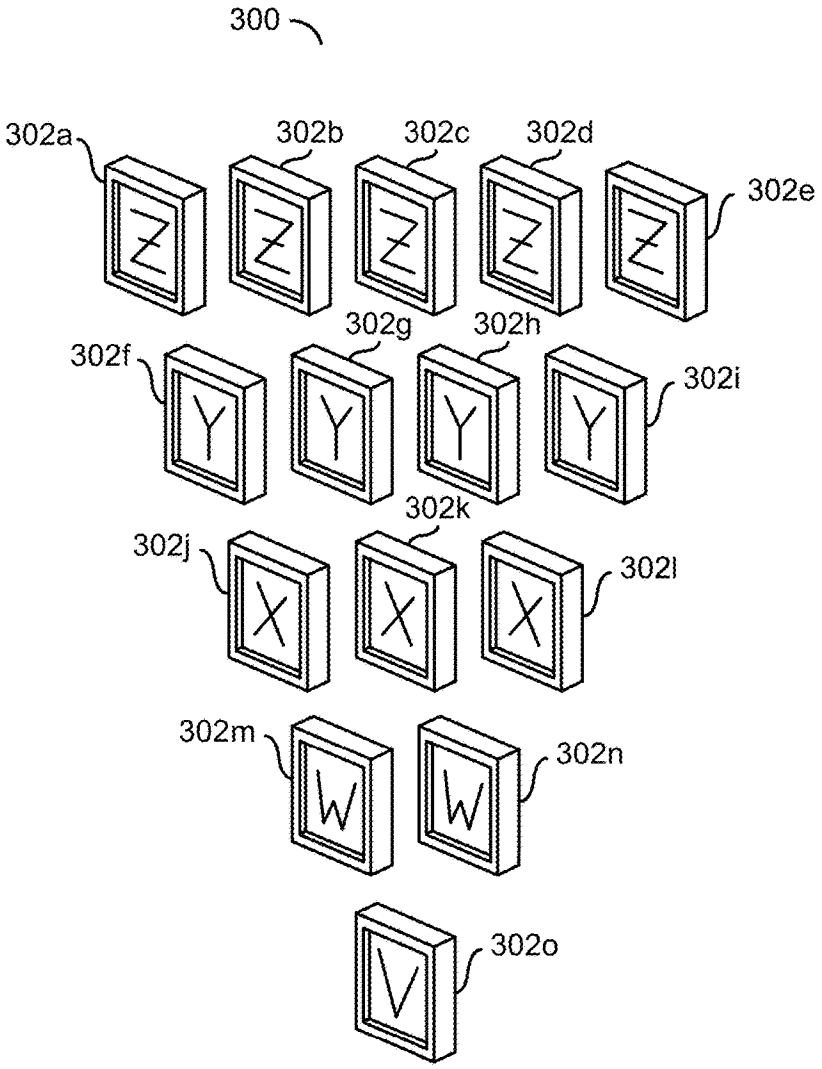

Referring to FIGS. 4A and 4B, diagrams are shown illustrating first (front) faces (FIG. 4A) and second (back) faces (FIG. 4B) of another example set of dual-sided playing pieces 300 in accordance with an example embodiment of the invention. The dual-sided playing pieces 300 may be used in place of the dual-sided playing pieces 102 shown in FIGS. 1 and 2. In an example, the set of dual-sided playing pieces 300 comprises fifteen dual-sided playing pieces 302*a*-302*o* and six indicia (e.g., letters Z, Y, X, W, V, and U). Each of the front faces of the dual-sided playing pieces 302*a*-302*o* generally has a first indicia (e.g., the letters Z, Y, X, W, or V) and each of the back faces of the dual-sided playing pieces 302*a*-302*o* generally has a second indicia (e.g., the letters Y, X, W, V, or U) that is different from the first indicia on the respective front faces of the dual-sided playing pieces 302*a*-302*o*.

In an example embodiment, the front face of the dual-sided playing pieces 302*a*-302*e* may have a first of the six indicia (e.g., the numeral Z), the front face of the dual-sided playing pieces 302*f*-302*i* may have a second of the six indicia (e.g., the numeral Y), the front face of the dual-sided playing pieces 302*j*-3021 may have a third of the six indicia (e.g., the numeral X), the front face of the dual-sided playing pieces 302*m* and 302*n* may have a fourth of the six indicia (e.g., the numeral W), and the front face of the dual-sided playing piece 302*o* may have a fifth of the six indicia (e.g., the numeral V). In an example, the back face of the dual-sided playing pieces 302*a*-302*e* may have an indicia different from the front face and each other (e.g., the letters Y, X, W, V, and U), the back faces of the dual-sided playing pieces 302*f*-302*i* may have an indicia different from the front faces of the dual-sided playing pieces 302*a*-302*i* and each other (e.g., the letters X, W, V, and U), the back faces of the dual-sided playing pieces 302*j*-3021 may have an indicia different from the front faces of the dual-sided playing pieces 302*a*-3021 and each other (e.g., the letters W, V, and U), the front faces of the dual-sided playing pieces 302*m* and 302*n* may have an indicia different from the front faces of the dual-sided playing pieces 302*a*-302*n* and each other (e.g., the letters V and U), and the front face of the dual-sided playing piece 302*o* may have the sixth of the six indicia (e.g., the letter U). The distribution of the six indicia among the faces of the fifteen dual-sided playing pieces 302*a*-302*o* is generally configured to ensure that players may form sets during game play.

Figure 5B:
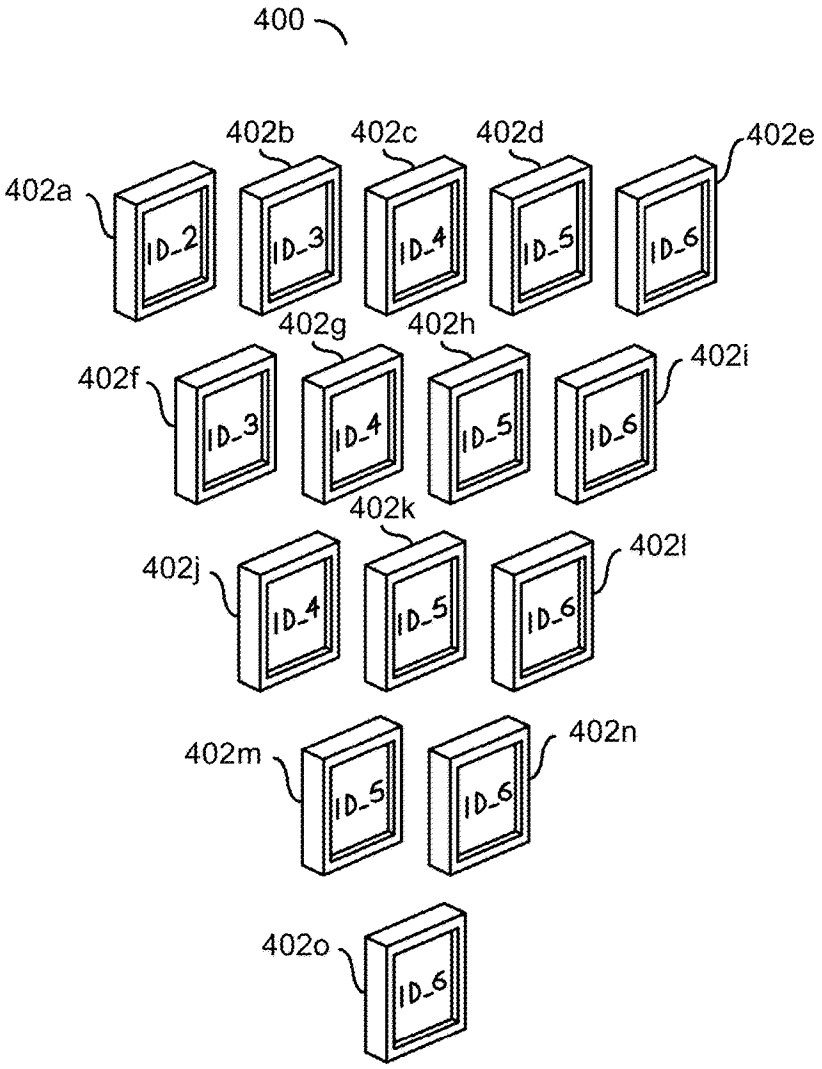
FIGS. 5A and 5B are diagrams illustrating yet another example set of dual-sided playing pieces (or tiles) of a game apparatus in accordance with an example embodiment of the invention.
Figure 5A:
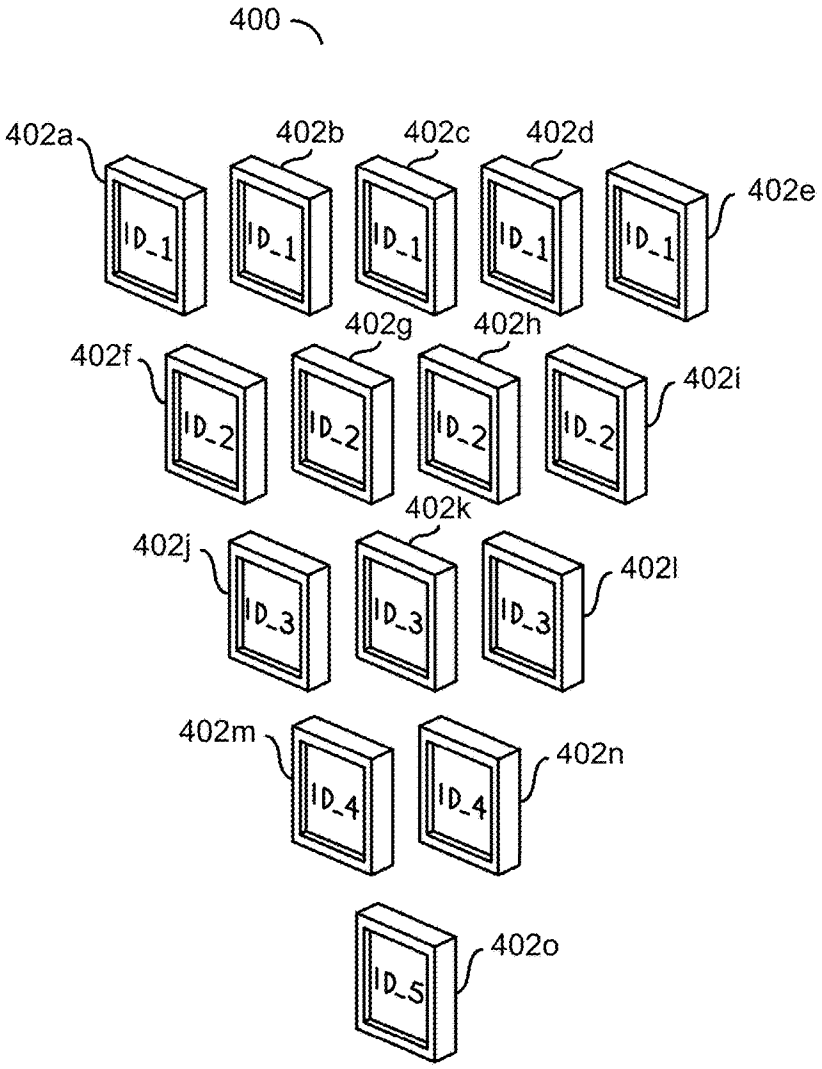

Referring to FIGS. 5A and 5B, diagrams are shown illustrating front faces (FIG. 5A) and back faces (FIG. 5B) of yet another example set of dual-sided playing pieces 400 in accordance with an example embodiment of the invention. The dual-sided playing pieces 400 may be used in place of the dual-sided playing pieces 102 shown in FIGS. 1 and 2. In an example, the set of dual-sided playing pieces 400 comprises fifteen dual-sided playing pieces 402*a*-402*o* illustrating a generic pattern for implementing the six indicia in accordance with an example embodiment of the invention. Each of the front faces of the dual-sided playing pieces 402*a*-402*o* generally has a first indicia selected from five of the six indicia (e.g., ID-1, ID-2, ID-3, ID-4, or ID-5) and each of the back faces of the dual-sided playing pieces 402*a*-402*o* generally has a second indicia that is different from the first indicia on the respective front faces of the dual-sided playing pieces 402*a*-402*o* and selected from a different five of the six indicia (e.g., ID-2, ID-3, ID-4, ID-5, or ID-6).

In an example, the front faces of the dual-sided playing pieces 402*a*-402*e* may have the indicia ID-1, the front faces of the dual-sided playing pieces 402*f*-402*i* may have the indicia ID-2, the front faces of the dual-sided playing pieces 402*j*-4021 may have the indicia ID-3, the front faces of the dual-sided playing pieces 402*m* and 202*n* may have the indicia ID-4, and the front face of the dual-sided playing piece 402*o* may have the indicia ID-5. In an example, the back face of the dual-sided playing pieces 402*a*-402*e* may have an indicia different from the front faces and each other (e.g., the indicia ID-2, ID-3, ID-4, ID-5, and ID-6), the back faces of the dual-sided playing pieces 402*f*-402*i* may have an indicia different from the front faces of the dual-sided playing pieces 402*a*-402*i* and each other (e.g., the indicia ID-3, ID-4, ID-5, and ID-6), the back faces of the dual-sided playing pieces 402*j*-4021 may have an indicia different from the front faces of the dual-sided playing pieces 402*a*-4021 and each other (e.g., the indicia ID-4, ID-5, and ID-6), the front faces of the dual-sided playing pieces 402*m* and 402*n* may have an indicia different from the front faces of the dual-sided playing pieces 402*a*-402*n* and each other (e.g., the indicia ID-5 and ID-6), and the front face of the dual-sided playing piece 402*o* may have the indicia ID-6.

In various embodiments, the six indicia ID-1, ID-2, ID-3, ID-4, ID-5, and ID-6 may be anything (e.g., alpha-numeric characters, symbols, pictures, pictograms, hieroglyphics, etc.) that have differences and orientations that are easily discernable. In an example, a line (or other indicator) may be added to clearly indicate a particular orientation of indicia. For example, a line might be used to clearly differentiate between the numerals 6 and 9 when both are present in a set of indicia.

Referring to FIG. 6, a diagram is shown of a plan view 500 illustrating an initial set up of the game apparatus 100 for two player game play. In various embodiments, the set of dual-sided playing pieces 102 are placed in a container (e.g., the game box, a sack, etc.) and the players take turns picking out eight dual-sided playing pieces 102*a*-102*h* and placing them in the eight spots (locations) around the stock tray 104, starting with the upper left spot and going clockwise. Each of the dual-sided playing pieces 102*a*-102*h* is generally placed with the indicia oriented as shown in FIG. 6. When the spots (or locations or positions) around the stock tray 104 have been filled, each player takes a turn picking a dual-sided playing piece 102*i* and 102*j*, respectively, to be placed in the first slot of the stock tray 104 closest to the player. The front faces of the dual-sided playing pieces 102*i* and 102*j* are shown facing upward only for clarity. The remaining five dual-sided playing pieces are then placed in the middle five slots of the stock tray 104 between the dual-sided playing pieces 102*i* and 102*j*.

Each player gets a collector tray 106 and a die 108. In an example, the two players may roll their respective die 108 and the highest valued indicia goes first. Play proceeds with each player rolling their die 108 and making a move based on the roll, if possible. The indicia rolled represents a dual-sided playing piece 102 that may be moved. If a move is possible, a player must make the move. If more than one move is possible, the player may select which move to make, but must make one of the moves. There are generally three possible moves that may be made in each turn: a flip, a shift, or a spin.

A flip comprises flipping a dual-sided playing piece 102 over and making sure the orientation of the newly exposed indicia is the same as the previously exposed indicia. A shift comprises switching places between the dual-sided playing piece 102 showing the indicia rolled and a horizontally or vertically adjacent dual-sided playing piece 102. A spin comprises rotating the dual-sided playing piece 102 showing the indicia rolled 180 degrees. Once a player has completed their turn, the other player (opponent) takes their turn. If a dual-sided playing piece 102 with the indicia rolled is not on the playing board (area), the other player (opponent) goes twice. Play continues until one player has formed enough sets (e.g., 4) to fill their collector tray 106.

Figure 7:
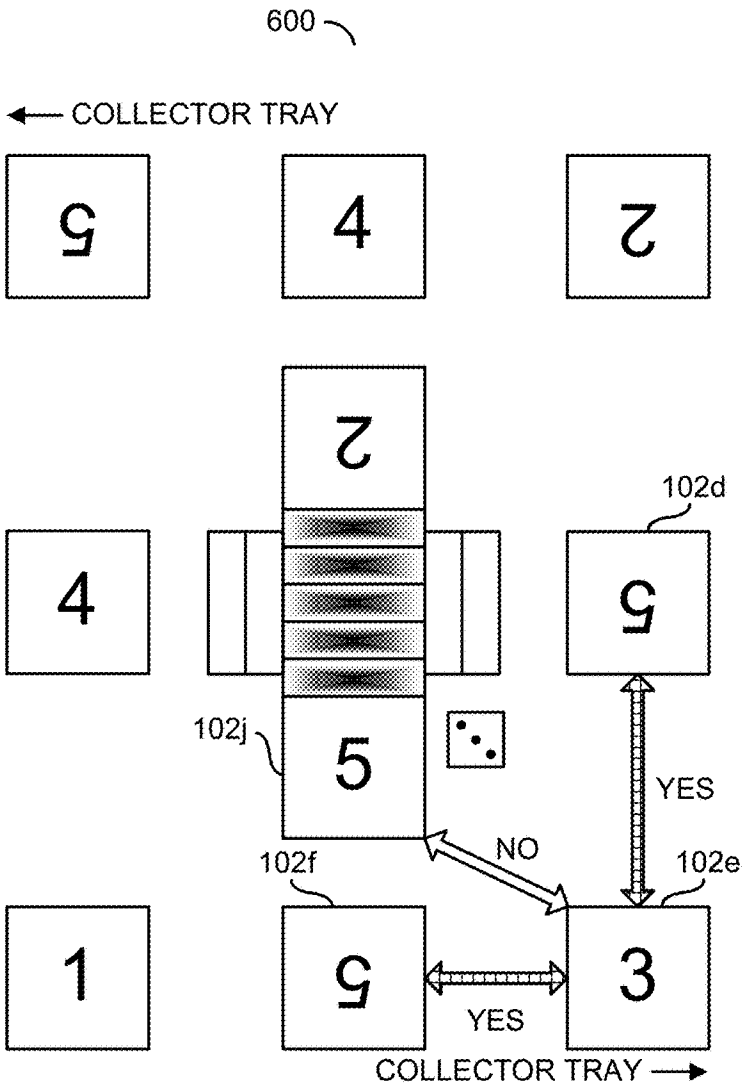
FIGS. 6-15 are diagrams illustrating various moves involved in two player game play.

Referring to FIG. 7, a diagram of a plan view 600 is shown illustrating a shift move in accordance with embodiments of the invention. A shift comprises switching places between the dual-sided playing piece 102 showing the indicia rolled and a horizontally or vertically adjacent dual-sided playing piece 102. In an example where a 3 is rolled, the dual-sided playing piece 102*e* showing a 3 may switch position with the dual-sided playing piece 102*d* above or the dual-sided playing piece 102*f* to the side (e.g. illustrated by the YES arrows). The dual-sided playing piece 102*e* showing the 3 may not switch position with the dual-sided playing piece 102*j* located diagonally from the dual-sided playing piece 102*e* showing the 3 (e.g. illustrated by the NO arrow).

Figure 8:
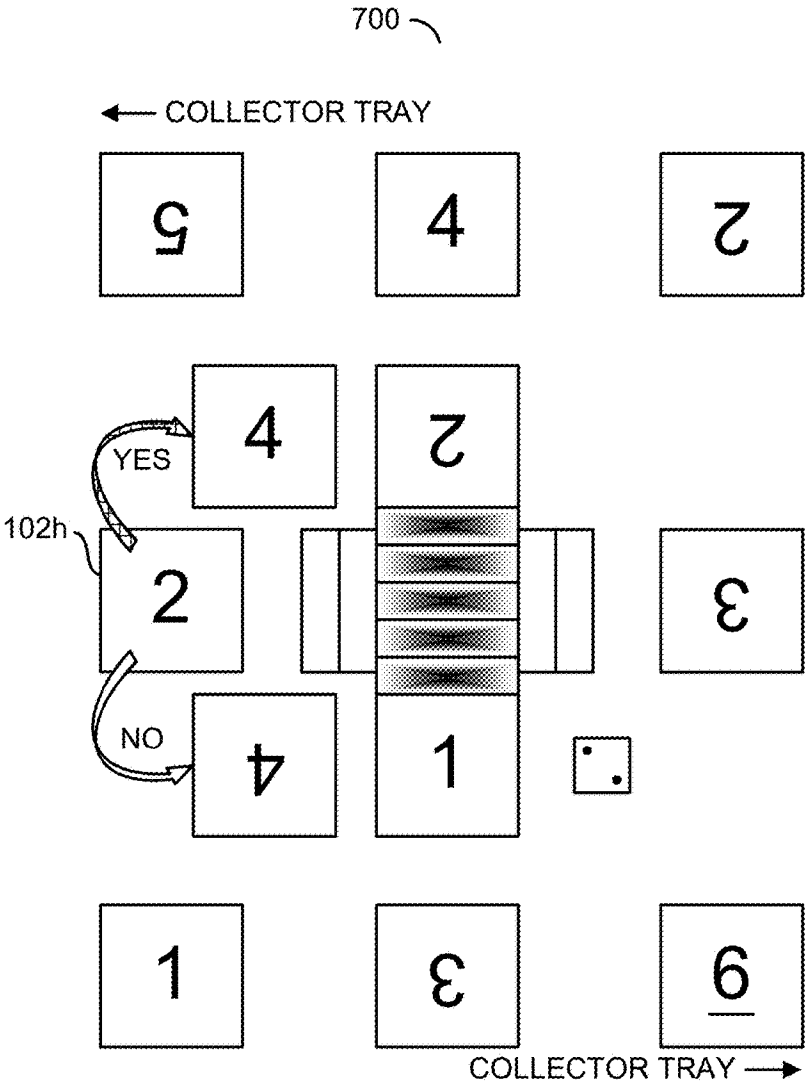

Referring to FIG. 8, a diagram is shown of a plan view 700 illustrating a flip move in accordance with embodiments of the invention. A flip comprises flipping over a dual-sided playing piece 102 showing the indicia rolled and making sure the orientation of the newly exposed indicia is the same as the previously exposed indicia. In an example where a 2 is rolled, the dual-sided playing piece 102*h* showing a 2 may be flipped over to expose the indicia on the other side of the dual-sided playing piece 102*h*. The orientation of the newly exposed indicia must be the same as the originally exposed indicia (e.g. illustrated by the YES arrow). The newly exposed indicia should not be oriented differently from the orientation of the original indicia (e.g. illustrated by the NO arrow).

Figure 9:
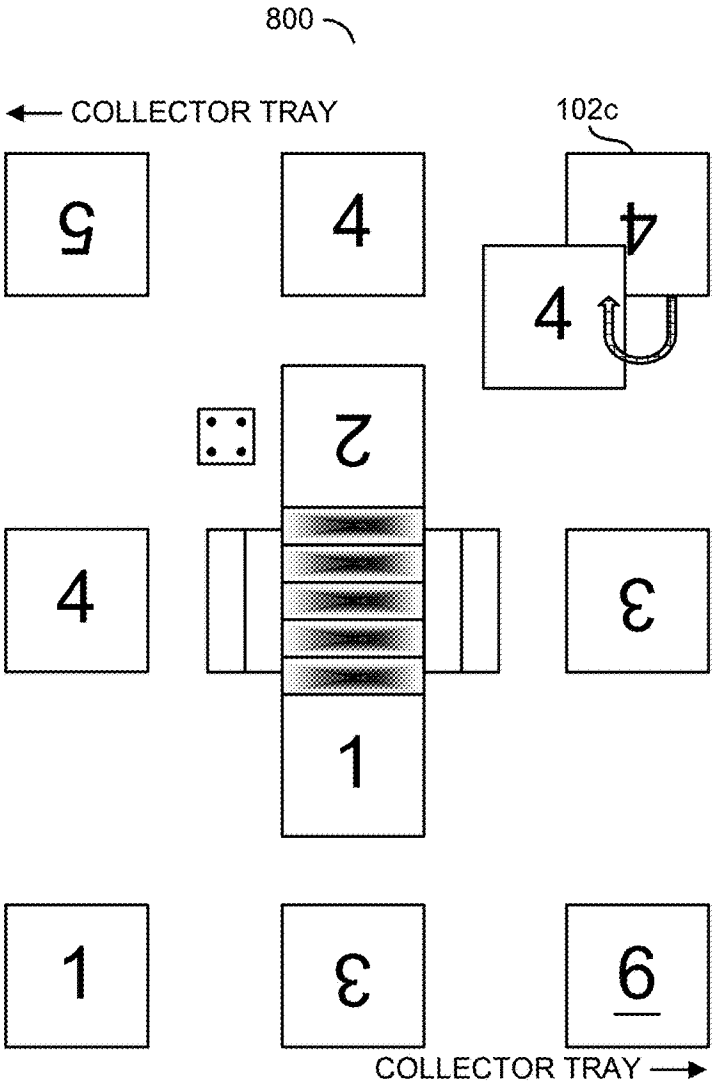

Referring to FIG. 9, a diagram is shown of a plan view 800 illustrating a spin move in accordance with embodiments of the invention. A spin comprises rotating the dual-sided playing piece 102 showing the indicia rolled 180 degrees. In an example where a 4 is rolled, the dual-sided playing piece 102*c* showing a 4 may be rotated 180 degrees to change the orientation of the indicia on the dual-sided playing piece 102*c* to an orientation needed by the player (e.g., to form a set, to block the opponent, etc.).

Figure 10:
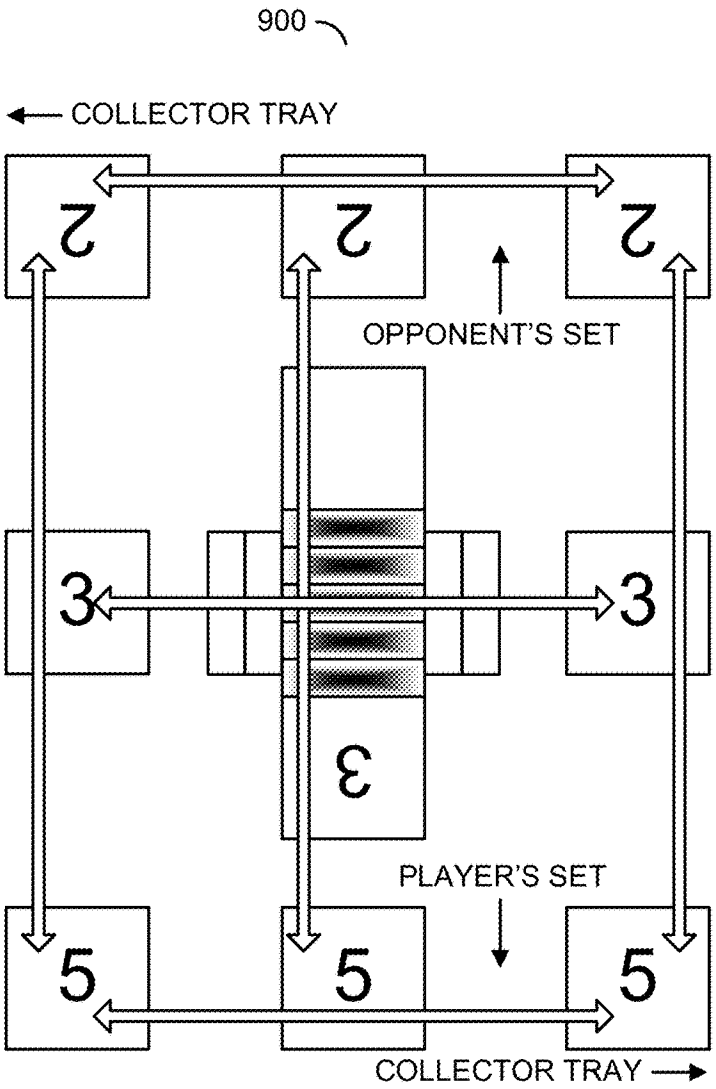

Referring to FIG. 10, a diagram is shown of a plan view 900 illustrating various ways in which sets may be formed. The objective of the game is to make a predetermined number of sets of three dual-sided playing pieces 102 with the same indicia, facing the player, with the correct orientation. Sets may only be formed horizontally and vertically, as shown by the arrows. Sets may not be formed diagonally. In one example, a first player has successfully made a set of three dual-sided playing pieces 102 with the same indicia (e.g., the numeral 5). In another example, the first player has successfully made a set of three dual-sided playing pieces 102 with the same indicia (e.g., the numeral 3) through the middle using the dual-sided playing pieces 102 in the stock tray 104. In another example, a second player (e.g., an opponent of the first player) has successfully made a set of three dual-sided playing pieces 102 with the same indicia (e.g., the numeral 2).

Figure 11:
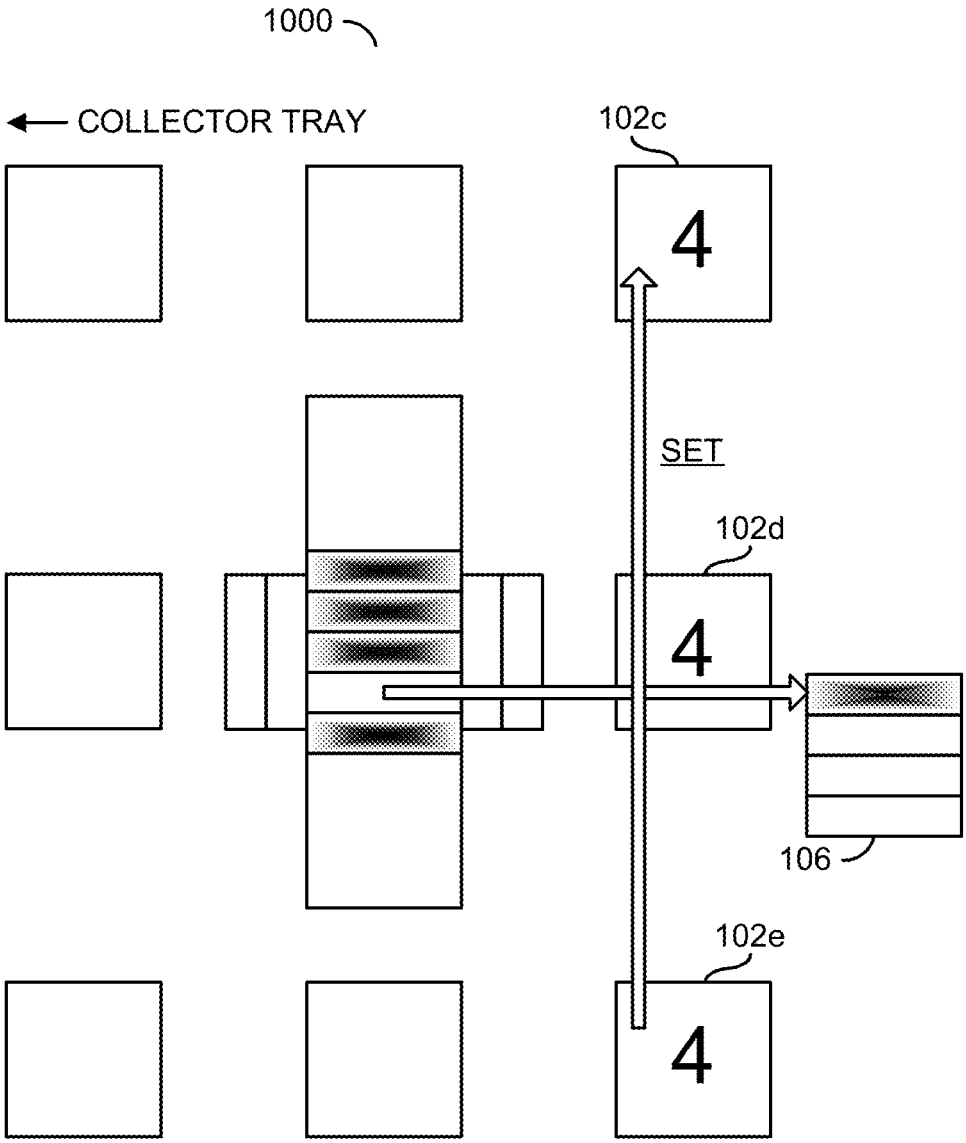

Referring to FIG. 11, a diagram is shown of a plan view 1000 illustrating scoring a point during two player game play. When a player has made a set (e.g., dual-sided playing pieces 102*c*, 102*d*, 102*e*), the player may take a dual-sided playing piece 102 from the middle slots of the stock tray 104 and place the dual-sided playing piece 102 into their collector tray 106. The collector tray 106 of the player as shown indicates the player has one point toward the four needed to win the game.

Figure 12:
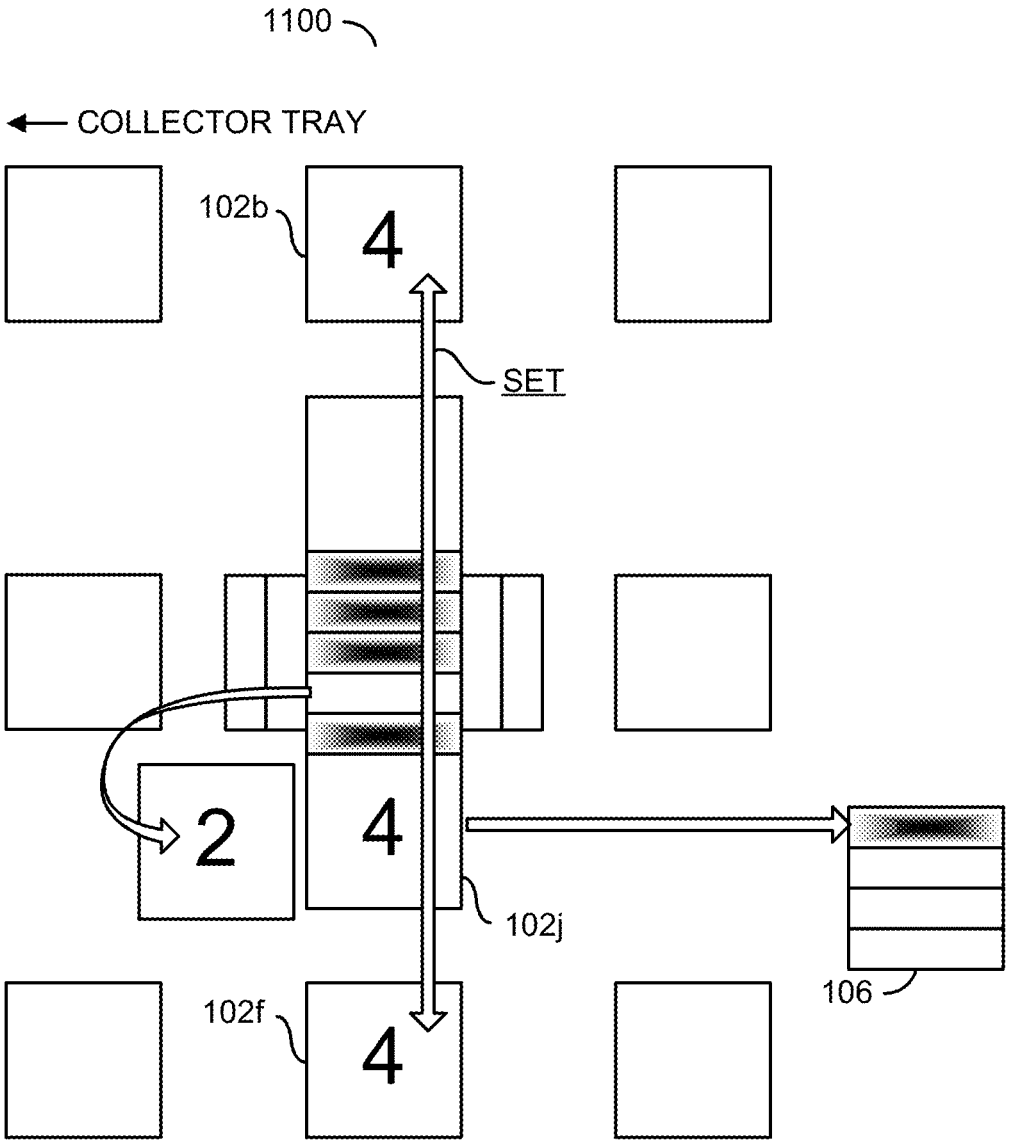

Referring to FIG. 12, a diagram is shown of a plan view 1100 illustrating scoring a point for a set involving the stock tray during two player game play. When a player makes a set with the dual-sided playing piece 102 in the stock tray 104 that is facing the player (e.g., dual-sided playing pieces 102*b*, 102*j*, 102*f*), the player may take the dual-sided playing piece 102*j* from the slot of the stock tray 104 and put the dual-sided playing piece 102*j* into their collector tray 106. The player then takes the next dual-sided playing piece 102 in the stock tray 104 and puts the dual-sided playing piece 102 into the slot from which the player removed the dual-sided playing piece 102*j*, while maintaining the correct orientation.

Figure 13:
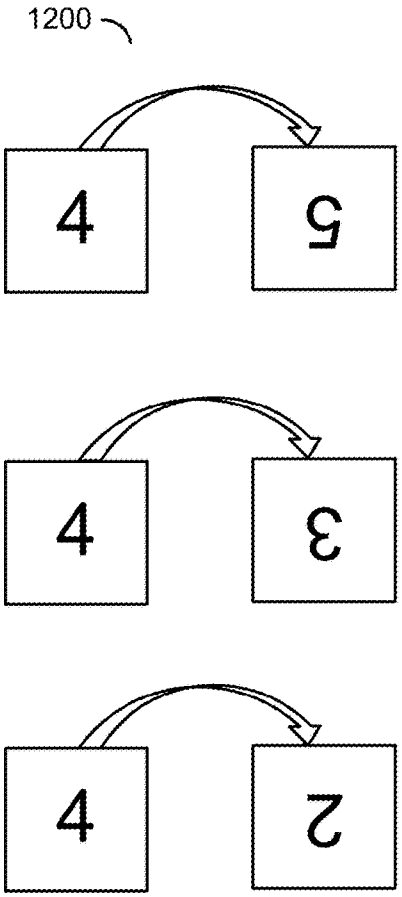

Referring to FIG. 13, a diagram is shown of a plan view 1200 illustrating game play after a set is formed. Once a player puts a dual-sided playing piece 102 is put in the collector tray 106, the player flips the dual-sided playing pieces 102 that made up the set so that the flipped dual-sided playing pieces 102 are oriented toward the opponent.

Figure 14:
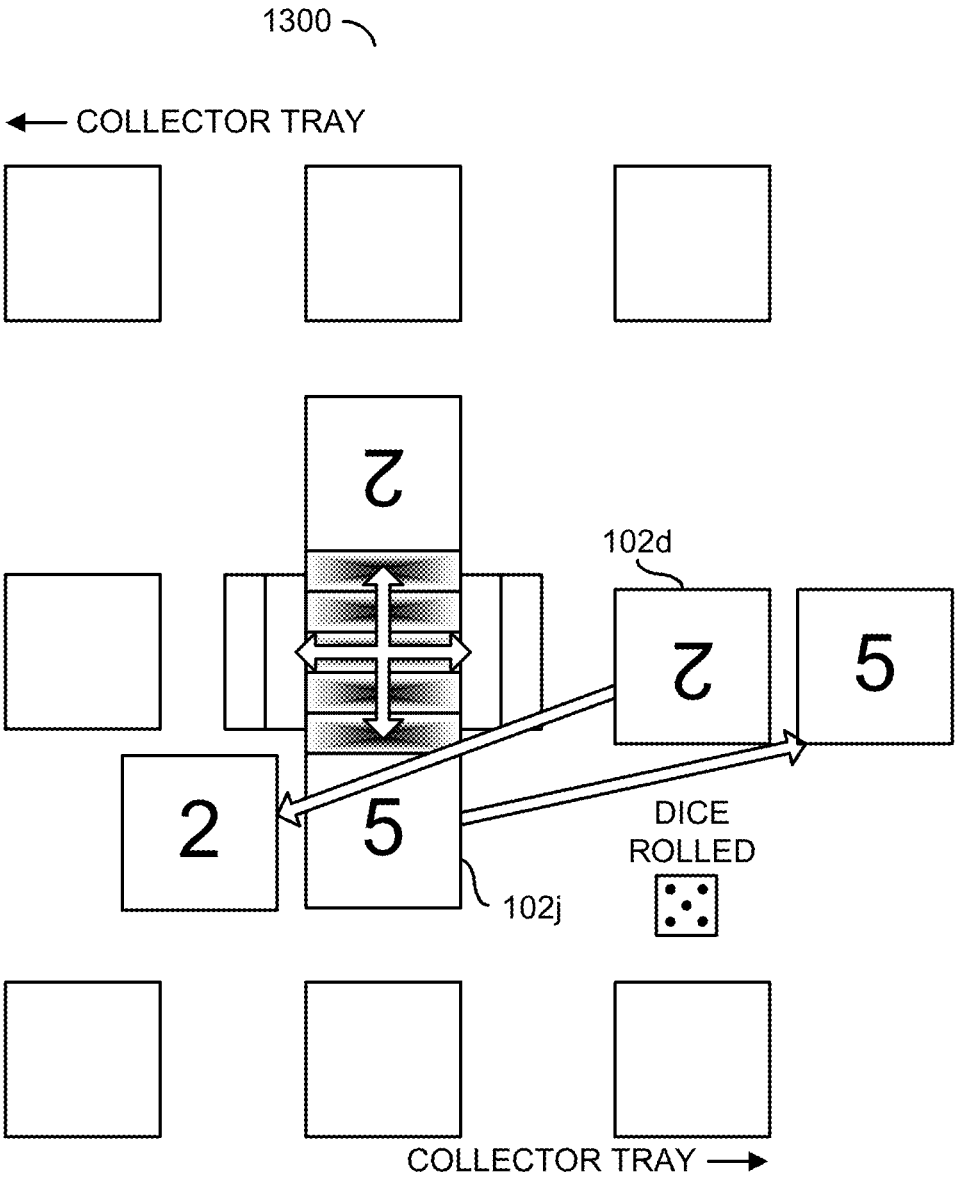

Referring to FIG. 14, a diagram is shown of a plan view 1300 illustrating shifting a dual-sided playing piece 102 in the stock tray 104 during two player game play. In the two player game, the dual-sided playing pieces 102*i* and 102*j* in the outside slot of the stock tray 104 may only be flipped or shifted, not spun. In the two player game, the dual-sided playing pieces 102*i* and 102*j* in the stock tray 104 never change their orientation. When a player rolls the indicia of the dual-sided playing piece 102 facing them in the stock tray 104 (e.g., the dual-sided playing piece 102*j*), the player may shift (swap) the dual-sided playing piece 102*j* in the stock tray 104 with a dual-sided playing piece 102 from the left, the right, above, or below. In an example, the player may shift (swap) the dual-sided playing piece 102*j* in the stock tray 104 with the dual-sided playing piece 102*d*. The orientation of the dual-sided playing piece 102*d* shifted into the stock tray 104 is set to match the orientation of the dual-sided playing piece 102*j* that was in the stock tray 104. The orientation of the dual-sided playing piece 102*j* shifted out of the stock tray 104 is maintained in the new location.

Figure 15:
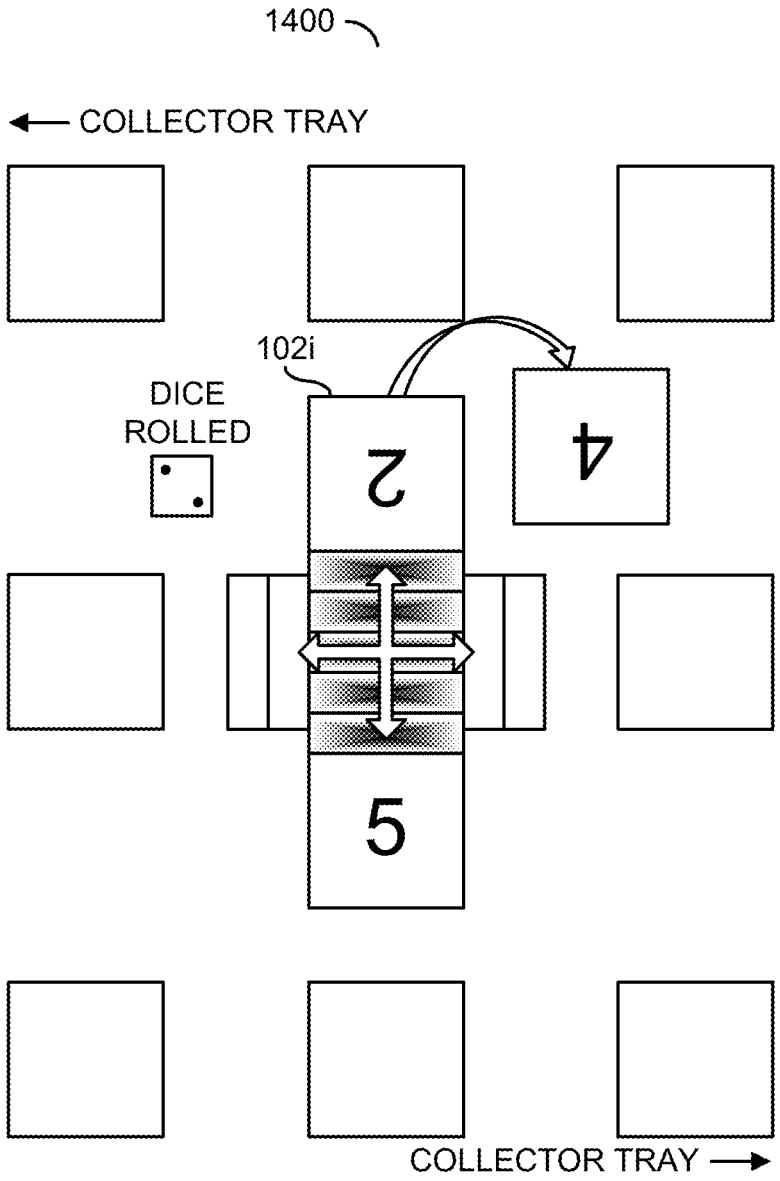

Referring to FIG. 15, a diagram is shown of a plan view 1400 illustrating flipping a tile in the stock tray 104 during two player game play. When a player rolls the indicia of the dual-sided playing piece 102 facing them in the stock tray 104 (e.g. the dual-sided playing piece 102*i*), the player may flip the dual-sided playing piece 102 in the stock tray 104 to expose the other side of the dual-sided playing piece 102 in the stock tray 104. The orientation of the newly exposed indicia of the dual-sided playing piece 102 in the stock tray 104 is maintained to match the orientation of the previously exposed indicia.

As game play progresses, the dual-sided playing pieces 102 in the stock tray 104 become depleted. When a player makes a set and there are no more dual-sided playing pieces 102 available in the stock tray 104, the player takes the dual-sided playing piece 102 facing them in the stock tray 104 as a point. The game continues until a player fills their collector tray 106 (e.g., scores 4 points). The player filling their collector tray 104 first is the winner.

Referring to FIG. 16, a diagram is shown of a plan view 1500 illustrating an initial set up of the game apparatus 100 for four player (two team) game play. In various embodiments, the set of dual-sided playing pieces 102 are placed in a container (e.g., the game box, a sack, etc.) and the players take turns picking out eight dual-sided playing pieces 102*a*-102*h* and placing them in the eight spots (locations) around the stock tray 104, starting with the upper left spot and going clockwise. In an example, each of the dual-sided playing pieces 102*a*-102*h* may be placed with the indicia oriented as shown in FIG. 16. When the spots (or locations or positions) around the stock tray 104 have been filled, each team takes a turn picking a dual-sided playing piece 102*i*, 102*j*, 102*k*, and 102*l*, respectively, to be placed in the first slot of the stock tray 104 closest to the player of the team picking. The front faces of the dual-sided playing pieces 102*i*, 102*j*, 102*k*, and 102*l* are shown facing upward only for clarity. The remaining three dual-sided playing pieces 102 are then placed in the middle three slots of the stock tray 104 between the dual-sided playing pieces 102*i* and 102*k*.

Each team gets a collector tray 106 and a die 108. In an example, the two teams may roll their respective die 108 and the highest valued indicia goes first. Play begins with the first player rolling a die 108 and making a move based on the roll, if possible. In an example, play proceeds to the left with each player rolling a die 108 and making a move based on the roll, if possible. The indicia rolled represents a dual-sided playing piece 102 that may be moved. If a move is possible, a player must make the move. If more than one move is possible, the player may select which move to make, but must make one of the moves. There are generally three possible moves that may be made in each turn: a flip, a shift, or a spin. If a dual-sided playing piece 102 with the indicia rolled is not on the playing board (area), the next player goes twice.

A flip comprises flipping a dual-sided playing piece 102 over and making sure the orientation of the newly exposed indicia is the same as the previously exposed indicia. A shift comprises switching places between the dual-sided playing piece 102 showing the indicia rolled and a horizontally or vertically adjacent dual-sided playing piece 102. A spin comprises rotating the dual-sided playing piece 102 showing the indicia rolled 90 degrees. Once a player has completed their turn, the next player takes their turn. The objective of the game is to make a predetermined number of sets of three dual-sided playing pieces 102 with the same indicia, facing either player of the same team. Play continues until one team has formed enough sets (e.g., 4) to fill their collector tray 106.

Figure 17:
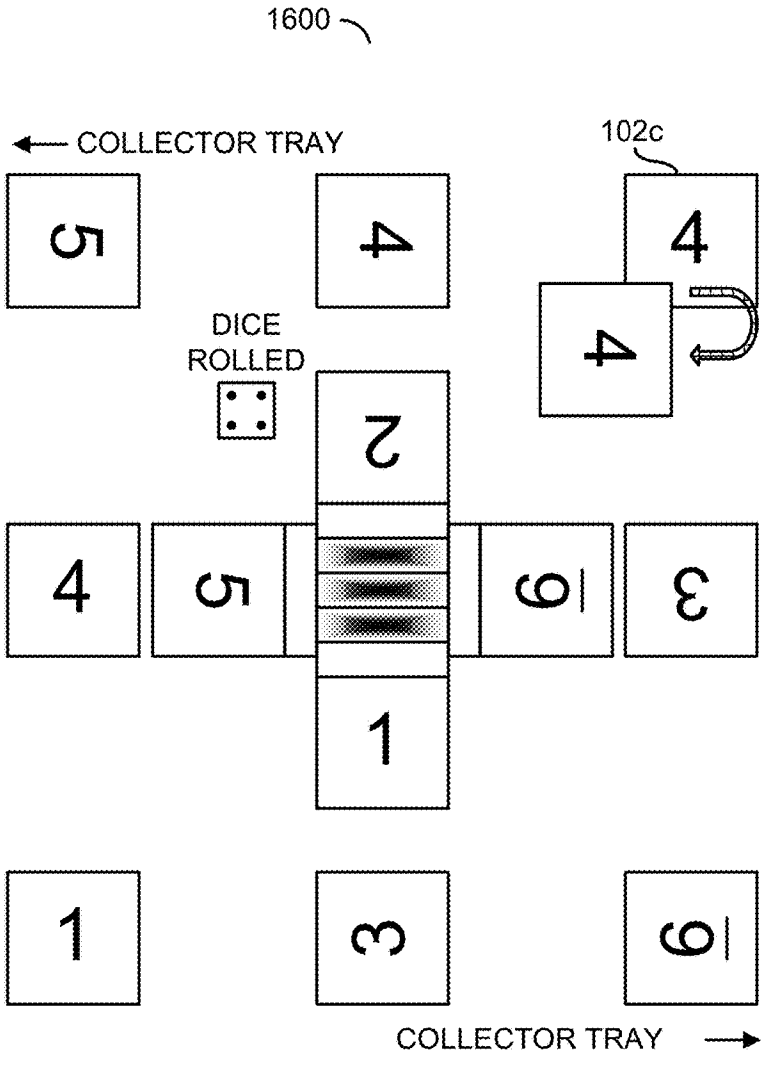
FIGS. 16-26 are diagrams illustrating various moves involved in four player game play.

Referring to FIG. 17, a diagram is shown of a plan view 1600 illustrating a spin move in accordance with embodiments of the invention. In the four-player game, a spin comprises rotating the dual-sided playing piece 102 showing the indicia rolled 90 degrees. In an example where a 4 is rolled, the dual-sided playing piece 102*c* showing a 4 may be rotated 90 degrees to change the orientation of the indicia on the dual-sided playing piece 102*c* to an orientation needed by the player/team (e.g., to form a set, to block the opponent team, etc.).

Figure 18:
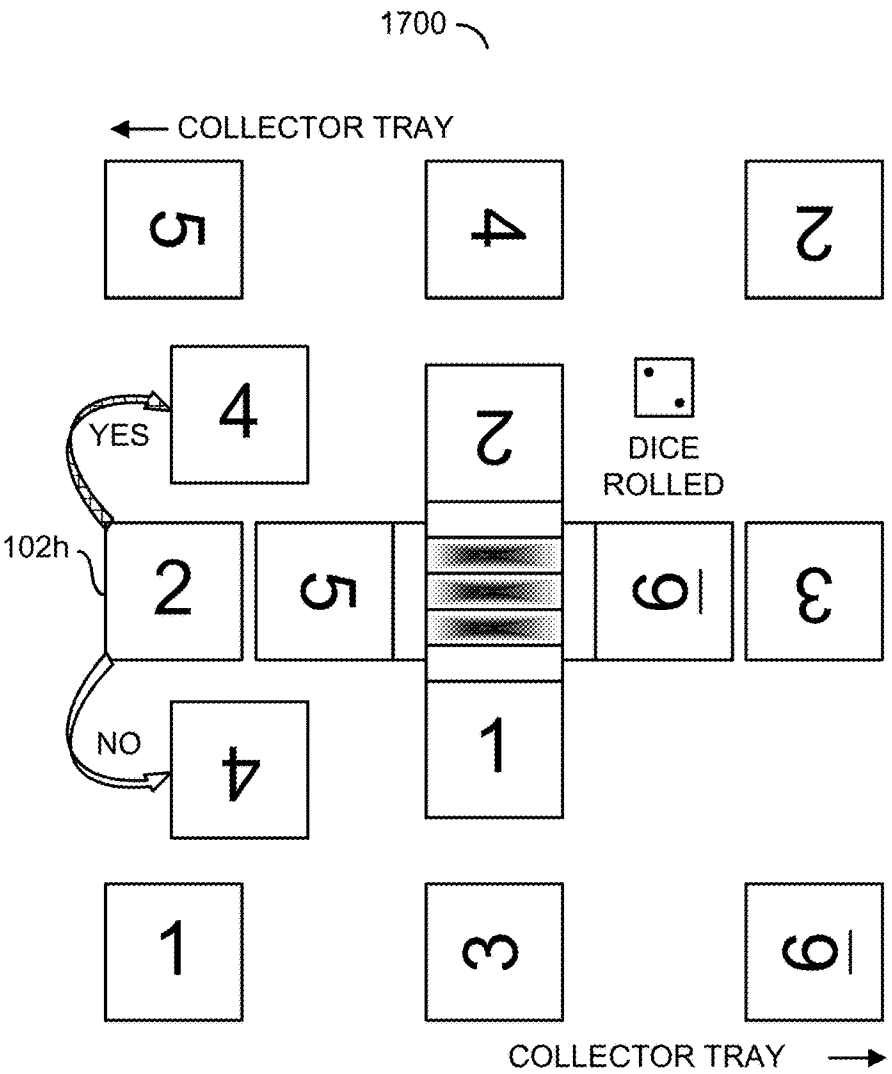

Referring to FIG. 18, a diagram is shown of a plan view 1700 illustrating a flip move in accordance with embodiments of the invention. In the four-player game, a flip comprises flipping over a dual-sided playing piece 102 showing the indicia rolled and making sure the orientation of the newly exposed indicia is the same as the previously exposed indicia. In an example where a 2 is rolled, the dual-sided playing piece 102*h* showing a 2 may be flipped over to expose the indicia on the other side of the dual-sided playing piece 102*h*. The orientation of the newly exposed indicia must be the same as the originally exposed indicia (e.g. illustrated by the YES arrow). The newly exposed indicia should not be oriented differently from the orientation of the original indicia (e.g. illustrated by the NO arrow).

Figure 19:
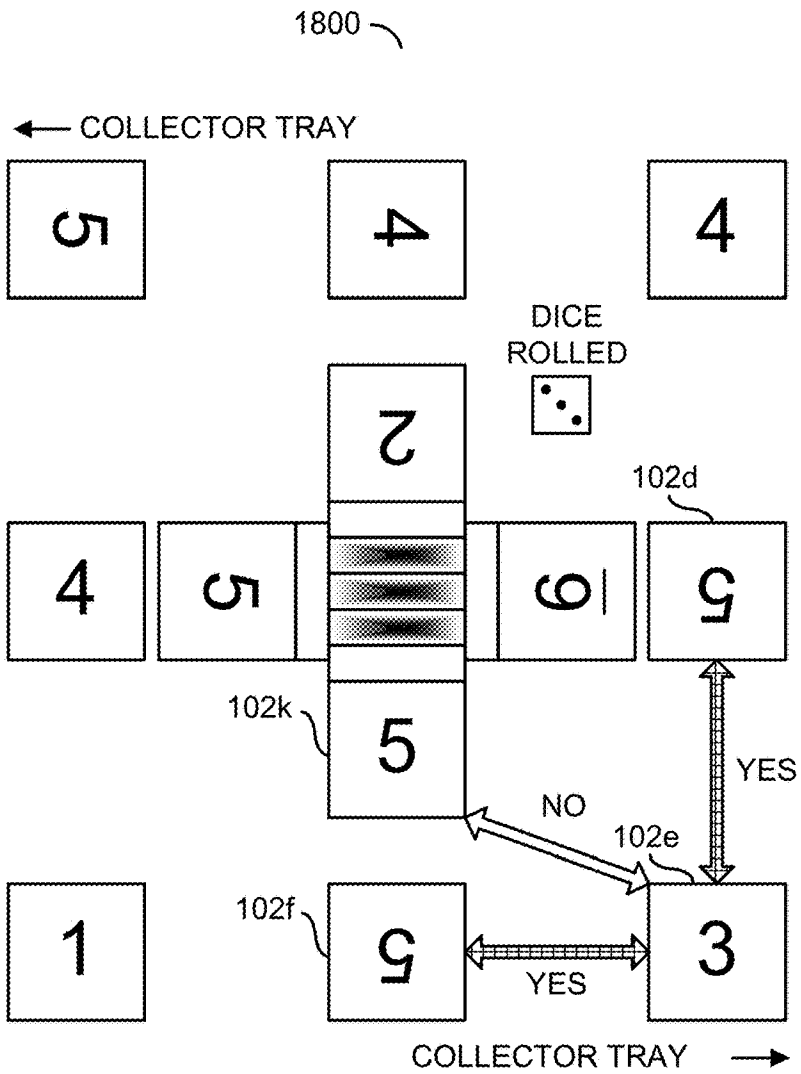

Referring to FIG. 19, a diagram is shown of a plan view 1800 illustrating a shift move in accordance with embodiments of the invention. In the four-player game, a shift comprises switching places between the dual-sided playing piece 102 showing the indicia rolled and a horizontally or vertically adjacent dual-sided playing piece 102. In an example where a 3 is rolled, the dual-sided playing piece 102*e* showing a 3 may switch position with the dual-sided playing piece 102*d* above or the dual-sided playing piece 102*f* to the side (e.g. illustrated by the YES arrows). The dual-sided playing piece 102*e* showing the 3 may not switch position with the dual-sided playing piece 102*k* located diagonally from the dual-sided playing piece 102*e* showing the 3 (e.g. illustrated by the NO arrow).

Figure 20:
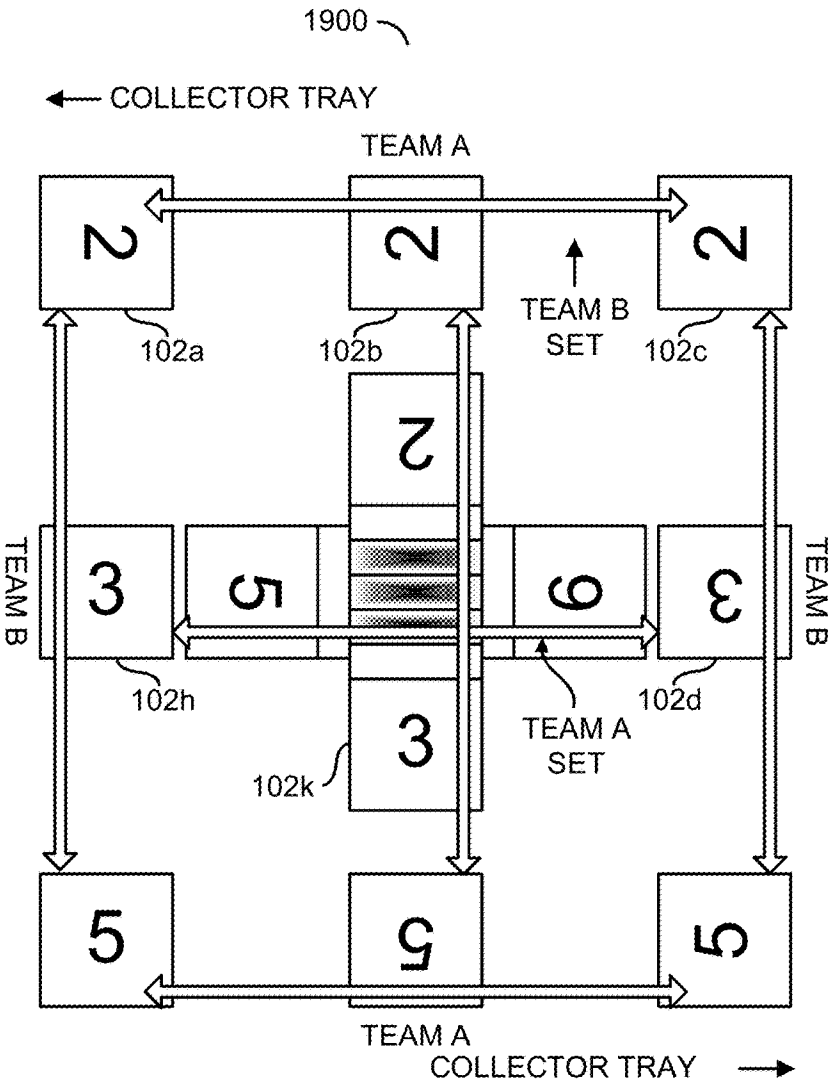

Referring to FIG. 20, a diagram is shown of a plan view 1900 illustrating various ways in which sets may be formed. In the four-player game, the objective of the game is to make a predetermined number of sets of three dual-sided playing pieces 102 with the same indicia, facing either player of the team. Sets may only be formed horizontally and vertically, as shown by the arrows. Sets may not be formed diagonally. In one example, TEAM A has successfully made a set of three dual-sided playing pieces 102*h*, 102*k*, and 102*d* with the same indicia (e.g., the numeral 3) through the middle using the dual-sided playing pieces 102*k* in the stock tray 104. In another example, TEAM B has successfully made a set of three dual-sided playing pieces 102*a*, 102*b*, and 102*c* with the same indicia (e.g., the numeral 2).

Figure 21:
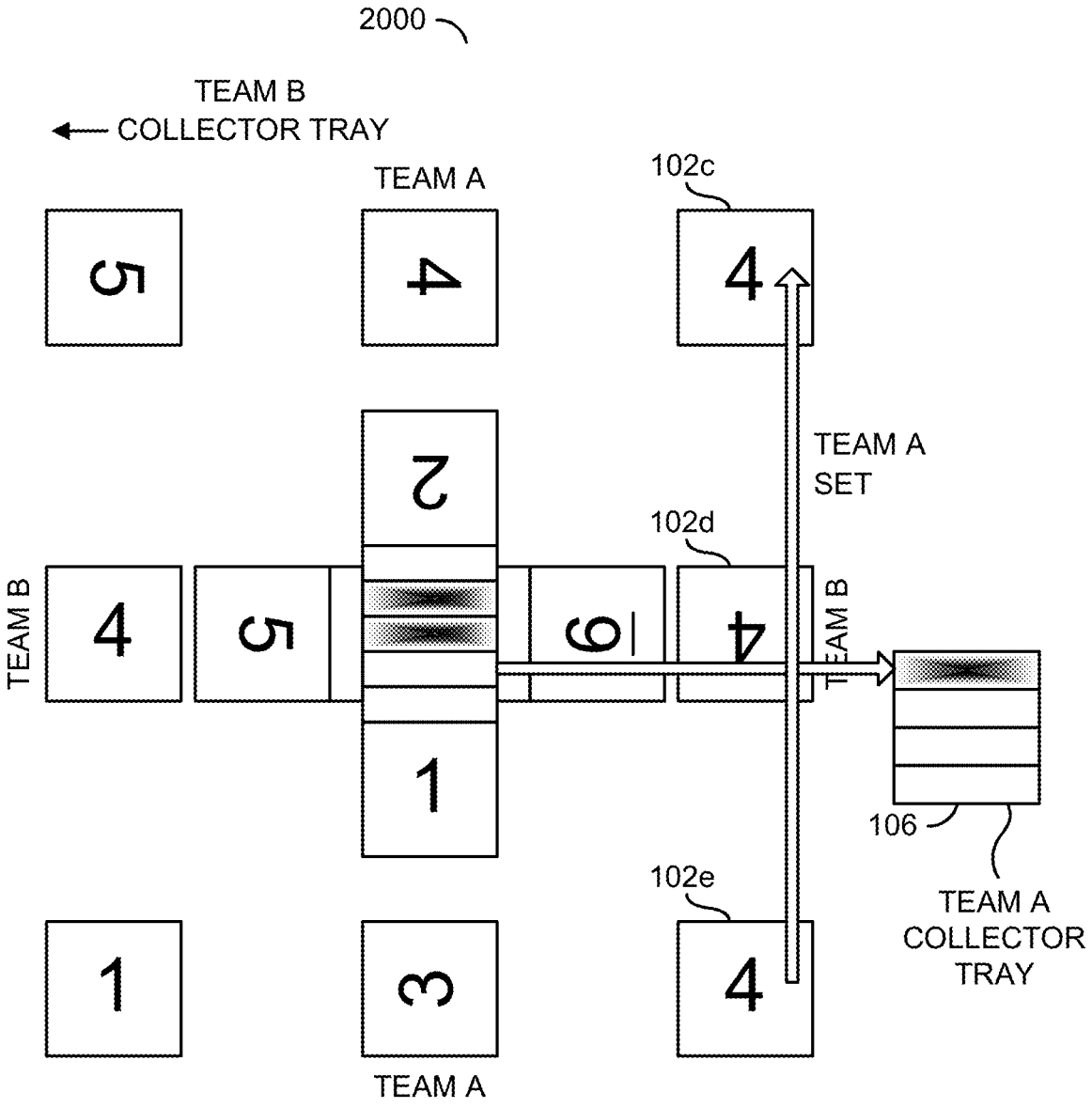

Referring to FIG. 21, a diagram is shown of a plan view 2000 illustrating scoring a point during four player game play. When a team has made a set (e.g., the dual-sided playing pieces 102*c*, 102*d*, 102*e*), the player of the team that made the set may take a dual-sided playing piece 102 from the middle slots of the stock tray 104 and place the dual-sided playing piece 102 into the collector tray 106 of the team. The collector tray 106 of the team as shown indicates the team has one point toward the four needed to win the game.

Figure 22:
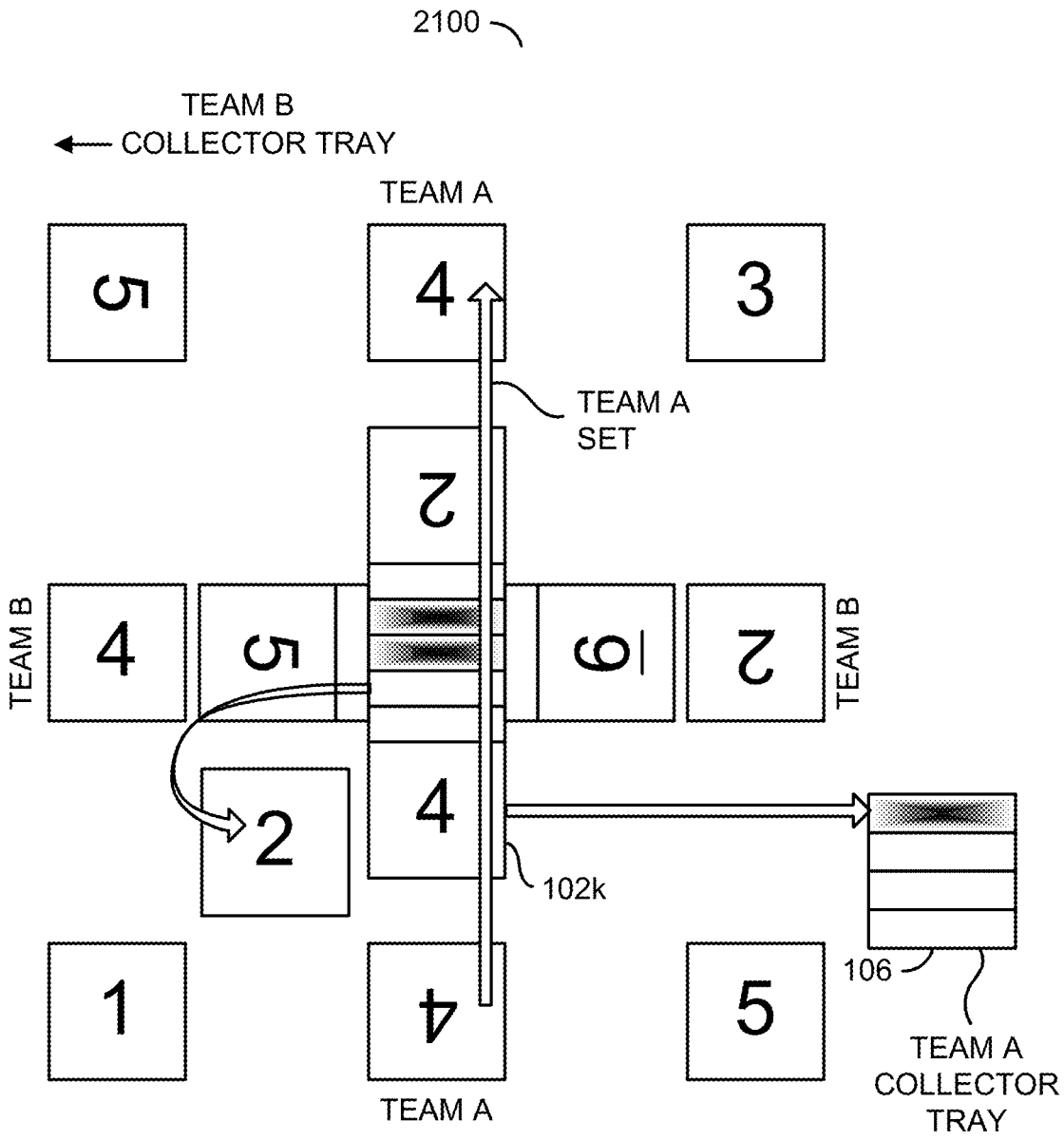

Referring to FIG. 22, a diagram is shown of a plan view 2100 illustrating scoring a point for a set involving the stock tray during four player game play. When a player of a team makes a set with the dual-sided playing piece 102 in the stock tray 104 that is facing the player (e.g., the dual-sided playing piece 102*k*), the player may take the dual-sided playing piece 102*k* from the slot of the stock tray 104 and put the dual-sided playing piece 102*k* into the collector tray 106 of their team. The player then takes the next dual-sided playing piece 102 in the stock tray 104 and puts the dual-sided playing piece 102 into the slot from which the player removed the dual-sided playing piece 102*k*, while maintaining the correct orientation.

Figure 23:
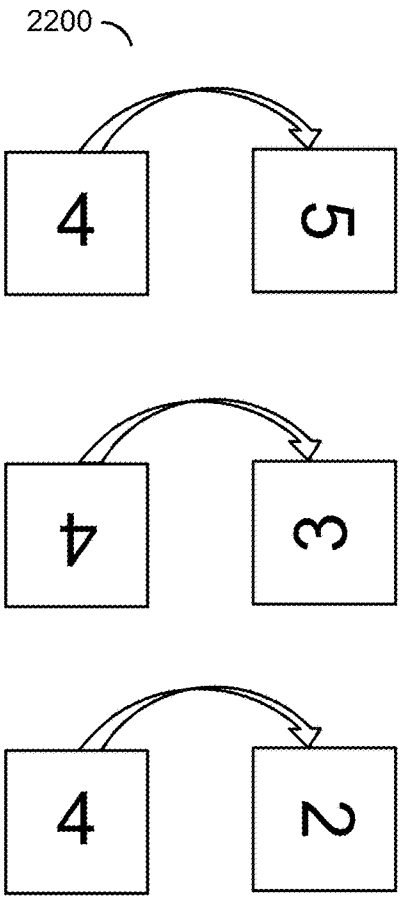

Referring to FIG. 23, a diagram is shown of a plan view 2200 illustrating four-player game play after a set is formed. Once a player of a team puts a dual-sided playing piece 102 in the collector tray 106 of the team, the player flips the dual-sided playing pieces 102 that made up the set so that the indicia orientation are changed.

Figure 24:
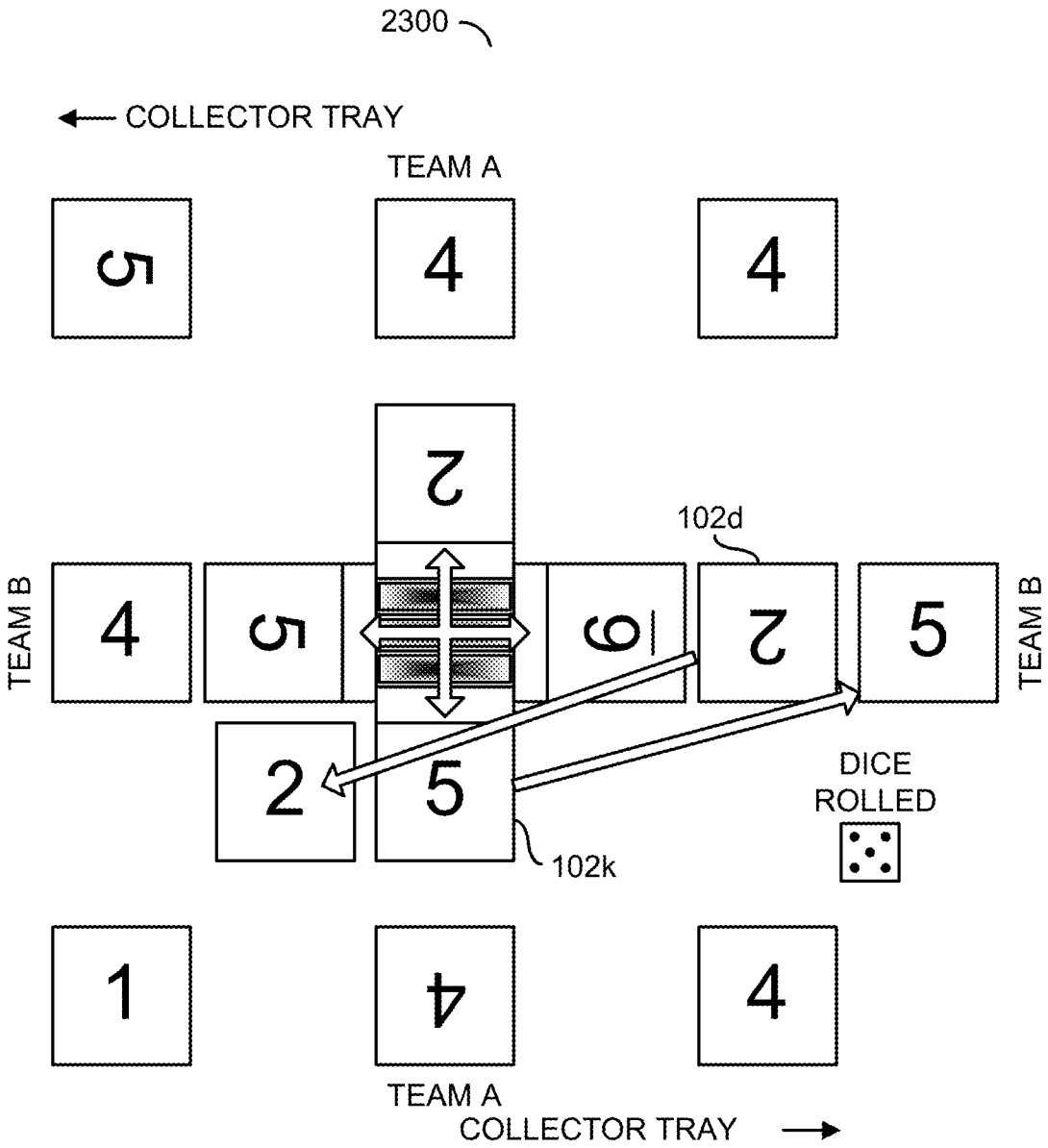

Referring to FIG. 24, a diagram is shown of a plan view 2300 illustrating shifting a dual-sided playing piece 102 in the stock tray 104 during four player game play. In the four player game, the dual-sided playing pieces 102*i*, 102*j*, 102*k*, and 102*l* in the outside slot of the stock tray 104 may only be flipped or shifted, not spun. In the four player game, the dual-sided playing pieces 102*i*, 102*j*, 102*k*, and 102*l* in the stock tray 104 never change their orientation. When a player rolls the indicia of the dual-sided playing piece 102 facing them in the stock tray 104 (e.g., the dual-sided playing piece 102*k*), the player may shift (swap) the dual-sided playing piece 102*k* in the stock tray 104 with a dual-sided playing piece 102 from the left, the right, above, or below. In an example, the player may shift (swap) the dual-sided playing piece 102*k* in the stock tray 104 with the dual-sided playing piece 102*d*. The orientation of the dual-sided playing piece 102*d* shifted into the stock tray 104 is set to match the orientation of the dual-sided playing piece 102*j* that was in the stock tray 104. The orientation of the dual-sided playing piece 102*k* shifted out of the stock tray 104 is maintained in the new location.

Figure 25:
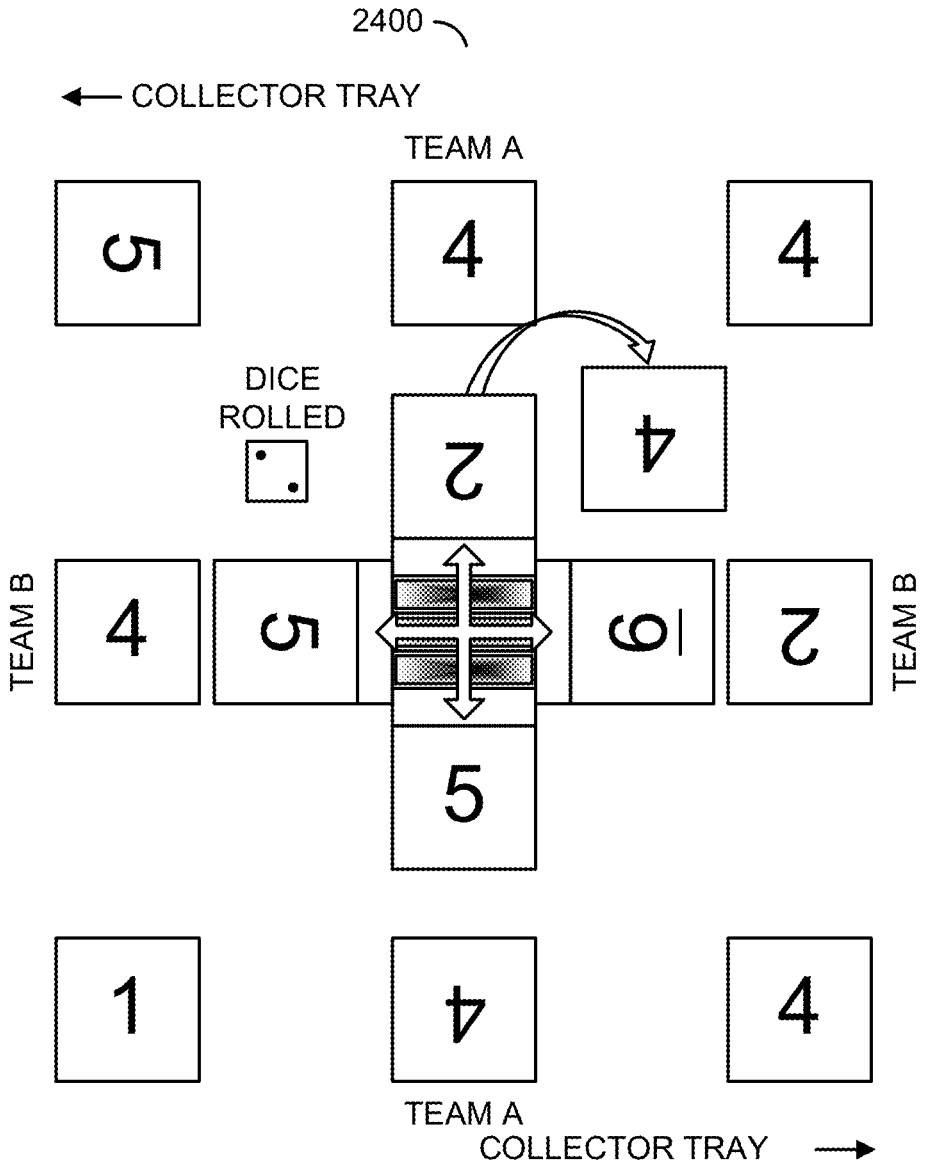

Referring to FIG. 25, a diagram is shown of a plan view 2400 illustrating flipping a tile in the stock tray 104 during four player game play. When a player rolls the indicia of the dual-sided playing piece 102 facing them in the stock tray 104 (e.g. the dual-sided playing piece 102*i*), the player may flip the dual-sided playing piece 102 in the stock tray 104 to expose the other side of the dual-sided playing piece 102 in the stock tray 104. The orientation of the newly exposed indicia of the dual-sided playing piece 102 in the stock tray 104 is maintained to match the orientation of the previously exposed indicia.

Figure 26:
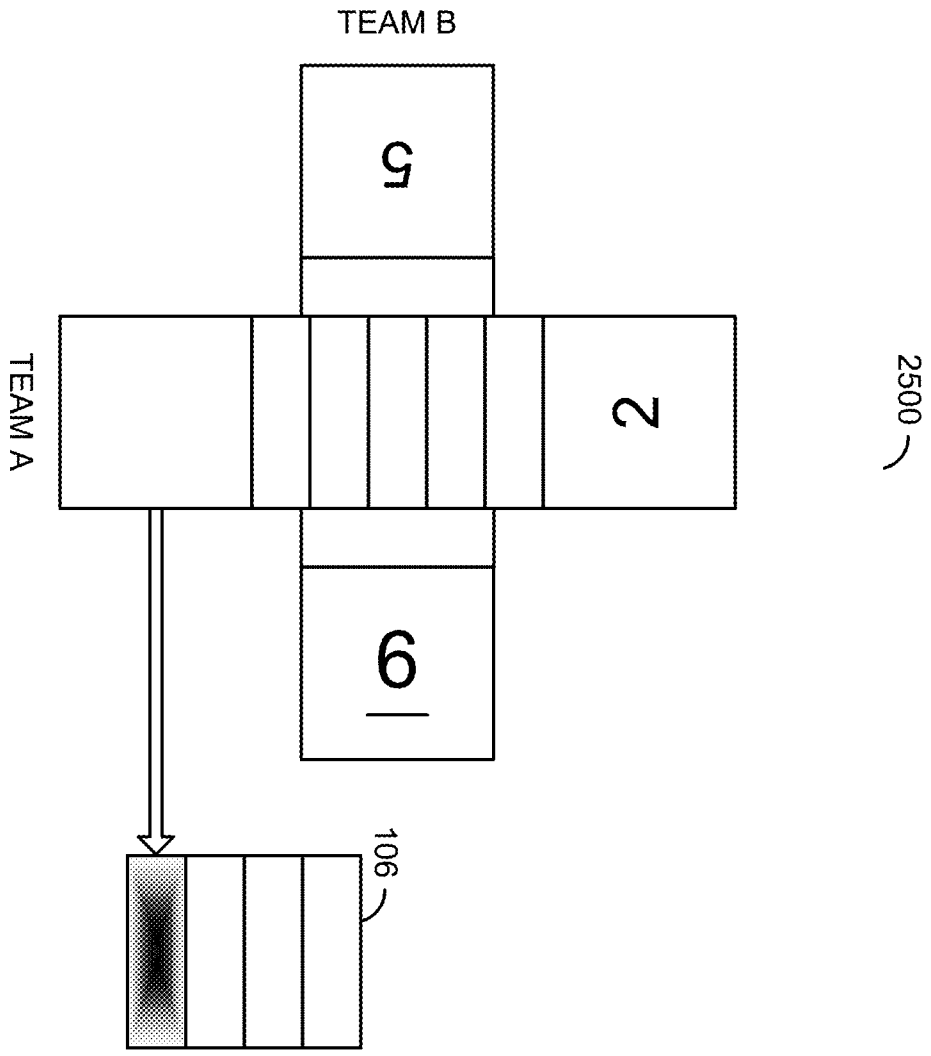

Referring to FIG. 26, a diagram is shown of a plan view 2500 illustrating game play when the stock tray 104 becomes depleted during four player game play. As game play progresses, the dual-sided playing pieces 102 in the stock tray 104 become depleted. When a team makes a set and there are no more dual-sided playing pieces 102 available in the stock tray 104, the team must take a dual-sided playing piece 102 facing them in the stock tray 104 as a point. If a dual-sided playing piece 102 facing the players of the team in the stock tray 104 is not available, then a dual-sided playing piece 102 facing the other team in the stock tray 104 is taken as a point. The game continues until a team fills their collector tray 106 (e.g., scores 4 points). The team filling their collector tray 104 first is the winner.

Figure 27:
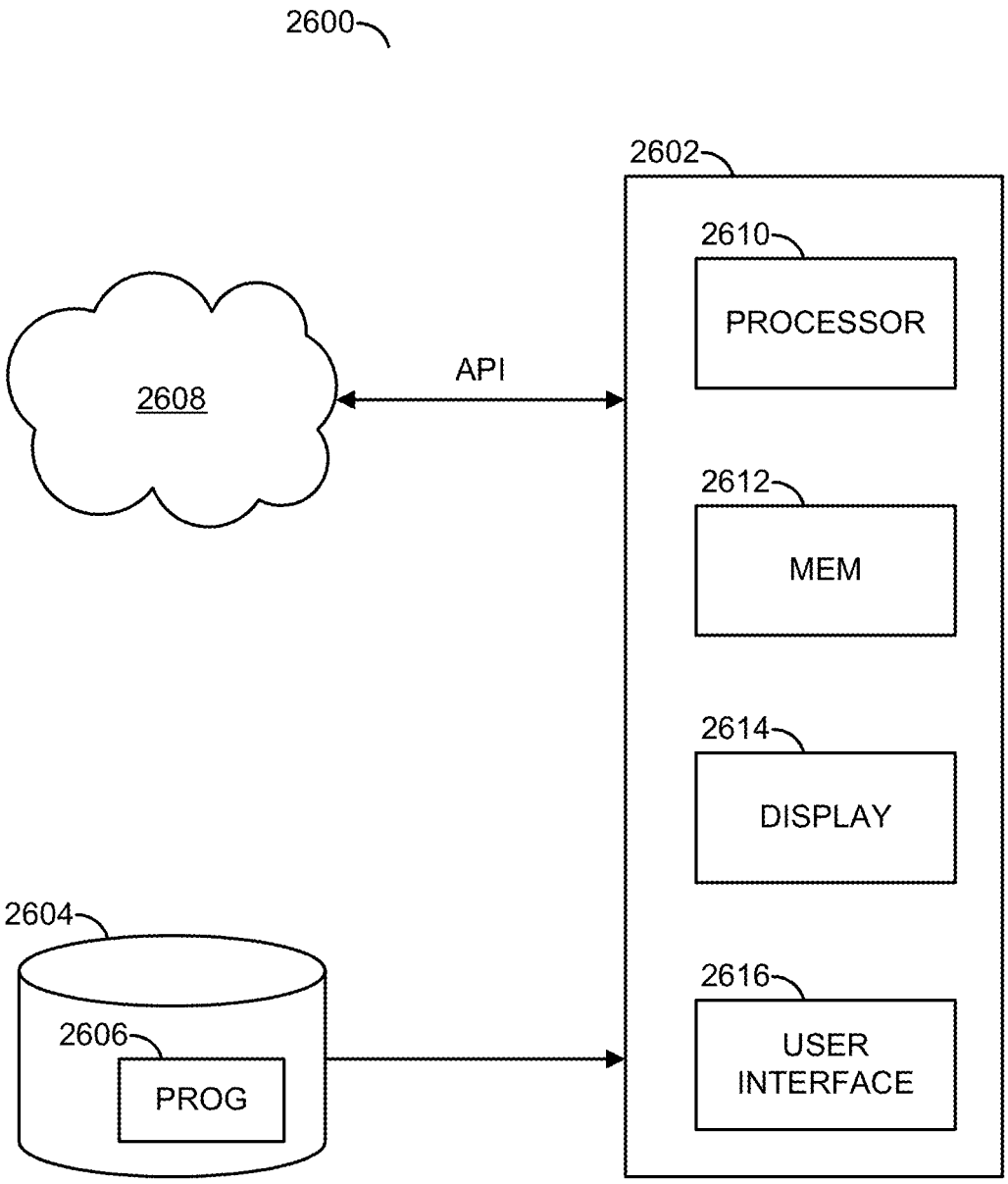
FIG. 27 is a diagram illustrating a computer system for use in computer-based game play in accordance with an example embodiment of the invention.

Referring to FIG. 27, a diagram is shown illustrating a computer system for use in computer-based game play. In an example, a system 2600 may be configured (e.g., through software) to provide a device for playing the game described above. In an example, the system 2600 may comprise a computer 2602 and a computer readable storage medium 2604. In an example, the computer 2602 may be implemented as a general purpose computer system. In an example, the computer readable storage medium 2604 may include, but is not limited to, a magnetic storage medium (e.g., a hard disk drive or HDD), an optical storage medium (e.g., compact disc (CD), digital video disc (DVD), BluRay disc (BD), a solid state drive (SSD), and a network associated storage system (NAS). In an example, the computer 2602 and the computer readable storage medium 2604 may be coupled together to exchange programs and data. In an example, a program (or programs) 2606 implementing the game described herein may be stored on the computer readable storage medium 2604 or in cloud based resources 2608. In an example, the computer 2602 may be connected to the cloud based resources 2608. In an example, the computer 26302 may be further configured to perform the program 2606 utilizing the cloud resources 2308. In an example, the computer 2602 may be configured to perform the program 2606 via one or more application program interfaces (APIs).

In an example, the computer 2602 may include, but is not limited to, a processor 2610, memory 2612, a display 2614, and a user interface 2616. In various embodiments, the processor 2610 may include, but is not limited to, a central processing unit (CPU), a graphics processing unit (GPU), and a video processing unit (VPU). In various embodiments, the memory 2612 may include, but is not limited to, random access memory (e.g., SRAM, DRAM, FLASH, etc.), read only memory (ROM), and cache memory. The display 2614 and the user interface 2616 generally allow a user (player) to initiate and run the program 2606 using the computer 2602. In an example, two players or two teams may be connected via respective computers 2602 to the cloud resources 2608 to play the game described herein.

The terms "may" and "generally" when used herein in conjunction with "is(are)" and verbs are meant to communicate the intention that the description is exemplary and believed to be broad enough to encompass both the specific examples presented in the disclosure as well as alternative examples that could be derived based on the disclosure. The terms "may" and "generally" as used herein should not be construed to necessarily imply the desirability or possibility of omitting a corresponding element.

While the invention has been particularly shown and described with reference to embodiments thereof, it will be understood by those skilled in the art that various changes in form and details may be made without departing from the scope of the invention.

The invention claimed is:

1. A game apparatus comprising:

a set of fifteen dual-sided playing pieces, each having a first face comprising a first indicia selected from a plurality of indicia and a second face, opposite said first face, comprising a second indicia different from said first indicia selected from said plurality of indicia;

a pair of dice, each die comprising a number of facets corresponding to a number of indicia in said plurality of indicia, each indicia in said plurality of indicia either appearing or being represented by a symbol on one facet of each die;

a stock tray for holding a first predetermined number of said dual-sided playing pieces that are available for play; and at least two collector trays, each configured to hold a second predetermined number of said dual-sided playing pieces that are no longer available for play, wherein said second predetermined number is less than said first predetermined number.

2. The game apparatus according to claim 1, wherein the number of indicia is six.

3. The game apparatus according to claim 2, wherein each indicia occurs in the set of dual-sided playing pieces five times.

4. The game apparatus according to claim 1, wherein each of said indicia has a predefined orientation allowing a player to discern a top and a bottom of said indicia.

5. The game apparatus according to claim 1, wherein said indicia comprise numerals.

6. The game apparatus according to claim 5, wherein said numerals are represented by a corresponding number of pips.

7. The game apparatus according to claim 1, wherein said indicia comprise letters.

8. The game apparatus according to claim 1, wherein said indicia comprise graphical symbols.

9. The game apparatus according to claim 1, wherein said stock tray has a cross-like shape comprising eleven slots, seven slots coaxially aligned along a first axis and four slots coaxially aligned along a second axis perpendicular to the first axis, the four slots being divided into two groups of two slots with each group on an opposite side of the seven slots along the first axis.

10. The game apparatus according to claim 1, wherein each of said dual-sided playing pieces further comprise a third face, a fourth face, a fifth face, and a sixth face, wherein said third, fourth, fifth, and sixth faces are orthogonal to said first face and said second face.

11. The game apparatus according to claim 10, wherein said third, fourth, fifth, and sixth faces are smaller than said first face and said second face.

12. The game apparatus according to claim 10, wherein said stock tray and said collector trays comprise slots having dimensions similar to said third, fourth, fifth, and sixth faces.

13. The game apparatus according to claim 1, wherein each of said dual-sided playing pieces comprise a card.

14. The game apparatus according to claim 1, wherein said dual-sided playing pieces, said stock tray, and said collector trays are constructed from at least one of wood, a metallic material, a ceramic material, or a plastic material.

15. A method of playing a game comprising the steps of:

providing a set of fifteen dual-sided playing pieces, each having a first face comprising a first indicia selected from a plurality of indicia and a second face, opposite said first face, comprising a second indicia different from said first indicia selected from said plurality of indicia;

providing a pair of dice, each die comprising a number of facets corresponding to a number of indicia in said plurality of indicia, each indicia in said plurality of indicia either appearing or being represented by a symbol on one facet of each die;

providing a stock tray for holding a first predetermined number of said dual-sided playing pieces that are available for play;

providing at least two collector trays, each configured to hold a second predetermined number of said dual-sided playing pieces that are no longer available for play, wherein said second predetermined number is less than said first predetermined number;

placing eight out of said set of fifteen dual-sided playing pieces on a surface, arranged to form a square having three dual-sided playing pieces on each side of said square;

placing said stock tray within said square formed by the eight dual-sided playing pieces on said surface;

placing a remaining number of the set of fifteen dual-sided playing pieces in the stock tray according to set-up instructions of the game; and taking turns until a player has arranged three dual-sided playing pieces having a similar indicia, oriented in a predetermined direction, and in a line parallel to a side of the square, wherein each of said turns involves rolling a die and at least one of (i) flipping one of said dual-sided playing pieces on said surface that has an indicia matching the indicia on a top face of the die, (ii) rotating one of said dual-sided playing pieces on said surface that has the indicia matching the indicia on the top face of the die, or (iii) shifting one of said dual-sided playing pieces on said surface that has the indicia matching the indicia on the top face of the die.

16. The method according to claim 15, wherein flipping one of said dual-sided playing pieces comprises:

turning over the dual-sided playing piece showing the indicia rolled on said die and making sure an orientation of a newly exposed indicia is the same as a previously exposed indicia.

17. The method according to claim 15, wherein rotating one of said dual-sided playing pieces comprises:

in a two player game, rotating the dual-sided playing piece showing the indicia rolled on said die 180 degrees; and in a four player game, rotating the dual-sided playing piece showing the indicia rolled on said die 90 degrees.

18. The method according to claim 15, wherein shifting one of said dual-sided playing pieces comprises:

switching places between the dual-sided playing piece showing the indicia rolled on said die and a horizontally or vertically adjacent dual-sided playing piece.

19. The method according to claim 15, further comprising:

when the player has arranged three dual-sided playing pieces having a similar indicia, oriented in a predetermined direction, and in a line parallel to a side of the square, moving one of the dual-sided playing pieces from the stock tray to a respective one of the collector trays.

20. The method according to claim 15, further comprising:

continuing play until one of the collector trays has been filled.

* * * * *